US009850710B2

(12) United States Patent
Hay

(10) Patent No.: US 9,850,710 B2
(45) Date of Patent: Dec. 26, 2017

(54) ENHANCING TORQUE ELECTRIC MOTOR DRIVE AND CONTROL SYSTEM FOR ROTARY STEERABLE SYSTEM

(71) Applicant: Halliburton Energy Services, Inc., Houston, TX (US)

(72) Inventor: Richard Thomas Hay, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/907,357

(22) PCT Filed: Dec. 20, 2013

(86) PCT No.: PCT/US2013/076957
§ 371 (c)(1),
(2) Date: Jan. 25, 2016

(87) PCT Pub. No.: WO2015/094345
PCT Pub. Date: Jun. 25, 2015

(65) Prior Publication Data

US 2016/0168913 A1 Jun. 16, 2016

(51) Int. Cl.

| | |
|---|---|
| ***E21B 4/04*** | (2006.01) |
| ***E21B 3/00*** | (2006.01) |
| ***E21B 7/06*** | (2006.01) |

(52) U.S. Cl.
CPC ..... *E21B 4/04* (2013.01); *E21B 3/00* (2013.01); *E21B 7/067* (2013.01)

(58) Field of Classification Search
CPC ..... E21B 4/04; E21B 4/00; E21B 4/02; E21B 4/006; E21B 4/10; E21B 4/12; E21B 4/20;
(Continued)

(56) References Cited

U.S. PATENT DOCUMENTS

| | | | |
|---|---|---|---|
| 4,187,918 | A | 2/1980 | Clark |
| 4,253,532 | A | 3/1981 | Geczy |

(Continued)

FOREIGN PATENT DOCUMENTS

| | | | |
|---|---|---|---|
| CN | 102209832 | A | 10/2011 |
| RU | 2321717 | C1 | 4/2008 |

(Continued)

OTHER PUBLICATIONS

International Search Report and Written Opinion issued in related PCT Application No. PCT/US2013/076957 dated Sep. 25, 2014, 10 pages.

(Continued)

*Primary Examiner* — Wei Wang
(74) *Attorney, Agent, or Firm* — Alan Bryson; Baker Botts L.L.P.

(57) ABSTRACT

An example embodiment of a pipe-in-pipe electric motor assembly includes a drilling string that includes an inner pipe, an outer pipe, and an electric motor. The electric motor is provided with power supplied by the inner pipe and the outer pipe acting at least as conductors. A latching mechanism connects the drilling string and an electric motor output shaft. The electric motor output shaft is driven by the electric motor. The latching mechanism prevents the electric motor output shaft from rotating slower than the drilling string and associated methods.

19 Claims, 21 Drawing Sheets

(58) Field of Classification Search
CPC ... E21B 3/00; E21B 7/067; E21B 7/00; E21B 7/04; E21B 7/06; E21B 17/03; E21B 43/12; E21B 43/128
See application file for complete search history.

(56) References Cited

U.S. PATENT DOCUMENTS

| | | | | |
|---|---|---|---|---|
| 4,632,193 | A | 12/1986 | Geczy | |
| 4,722,402 | A * | 2/1988 | Weldon | E21B 4/12 175/104 |
| 6,092,610 | A | 7/2000 | Kosmala et al. | |
| 6,837,315 | B2 | 1/2005 | Pisoni et al. | |
| 7,735,581 | B2 | 6/2010 | Beylotte et al. | |
| 7,946,360 | B2 | 5/2011 | Orban et al. | |
| 2005/0173155 | A1 | 8/2005 | Nevlud et al. | |
| 2005/0194187 | A1* | 9/2005 | Gleitman | E21B 4/04 175/57 |
| 2009/0308659 | A1 | 12/2009 | Crowley et al. | |
| 2011/0214963 | A1 | 9/2011 | Beylotte et al. | |
| 2012/0234603 | A1 | 9/2012 | Vail, III | |

FOREIGN PATENT DOCUMENTS

| | | | |
|---|---|---|---|
| RU | 2469169 | C1 | 12/2012 |
| WO | 2013-105952 | A1 | 7/2013 |

OTHER PUBLICATIONS

Office Action issued in related Chinese Application No. 201380081036.0, dated Mar. 9, 2017 (10 pages).
Office Action issued in related RU Application No. 2016117324, dated Jun. 16, 2017 (10 pages).

* cited by examiner

ENHANCING TORQUE ELECTRIC MOTOR DRIVE AND CONTROL SYSTEM FOR ROTARY STEERABLE SYSTEM

CROSS-REFERENCE TO RELATED APPLICATION

The present application is a U.S. National Stage Application of International Application No. PCT/US2013/076957 filed Dec. 20, 2013, which is incorporated herein by reference in its entirety for all purposes.

BACKGROUND

The present disclosure relates generally to well drilling and completion operations and, more particularly, to systems and methods of using electric motors to drive a drill bit.

To produce hydrocarbons (e.g., oil, gas, etc.) from a subterranean formation, wellbores may be drilled that penetrate hydrocarbon-containing portions of the subterranean formation. In traditional drilling systems, rock destruction is carried out via rotary power. This rotary power may be provided to the drill bit by rotating the drill string at the surface using a rotary table or a top drive. Alternatively, the drill bit may be independently rotated by a downhole mud motor irrespective of drill string rotation. Through these modes of power provision, traditional bits such as tri-cone, polycrystalline diamond compact ("PDC"), and diamond bits are operated at varying speeds and torques.

When using a mud motor to generate the torque for performing drilling operations, hydraulic losses along the drill string can limit the desired flow rate of mud. This in turn may reduce the hydraulic power one can apply to the mud motor to generate torque. This is especially relevant for drilling systems such as Reelwell™ where the flow rates are reduced to levels approaching 30% of conventional flow rates. The dramatic drop in flow rate coupled with greater depths of drilling targeted for this technology may result in higher fluid friction during circulation and thus the need for higher circulating pressures. Such a system may impose serious limitations on the hydraulic power available to the bottom hole assembly in ultra extended reach drilling.

In addition, special modifications to positive displacement motors (PDMs) are often required to permit these systems to operate at the lower flow rates. These modifications may involve lowering the fluid volume required to drive the power section per rotation of the mud motor rotor by reducing the volume of fluid per stage section of the mud motor. At these lower flow rates, turbine motors would need to have tighter vane structures with higher blade angles and higher flow velocities across the smaller vanes to operate effectively. This may result in higher flow resistance and a greater risk of erosion from the mud flow for a given operating output torque.

FIGURES

Some specific example embodiments of the disclosure may be understood by referring, in part, to the following description and the accompanying drawings.

Figure 16A:
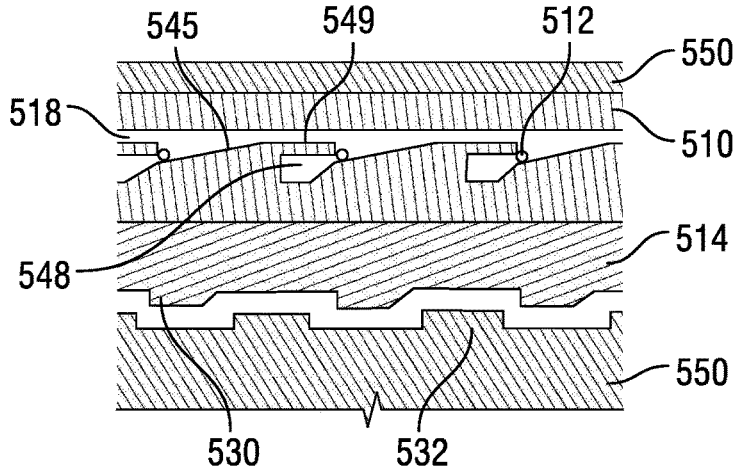
Figure 16B:
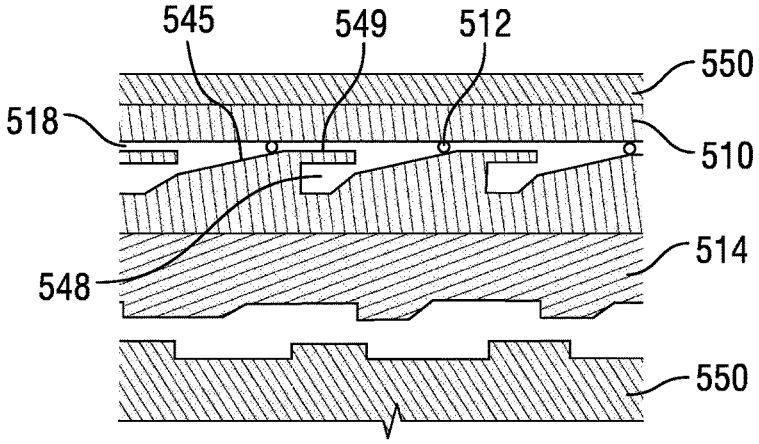
Figure 16C:
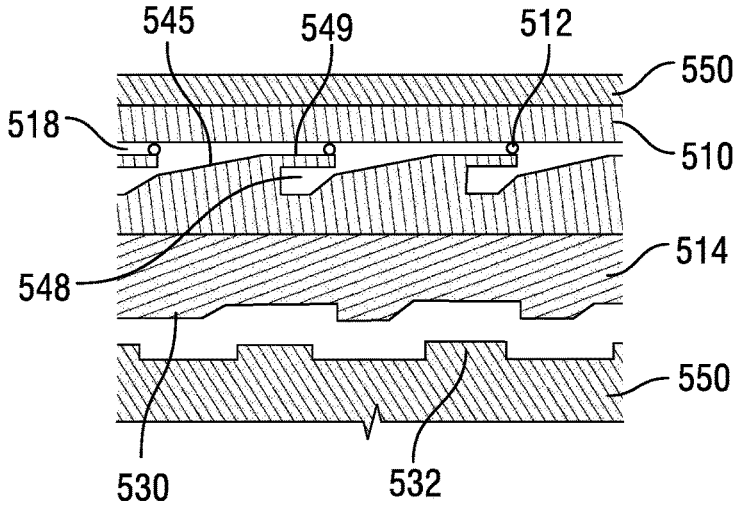

FIGS. 16A-C are roll-out views of an example latching mechanism at successive stages when the drive shaft rotates faster than the bearing housing.

Figure 16D:
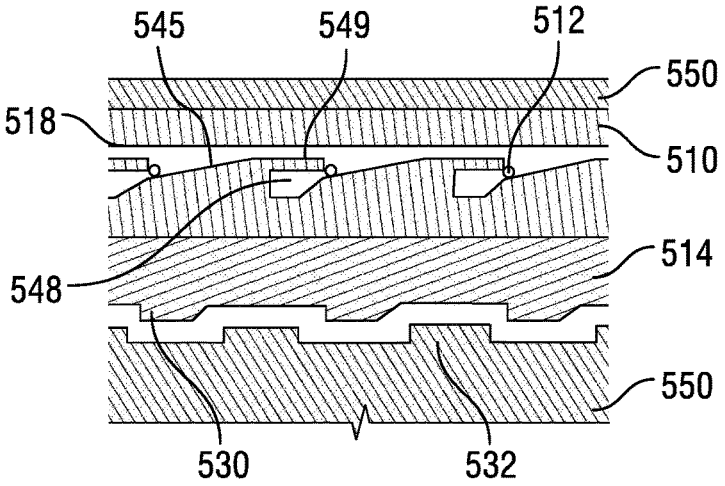
Figure 16E:
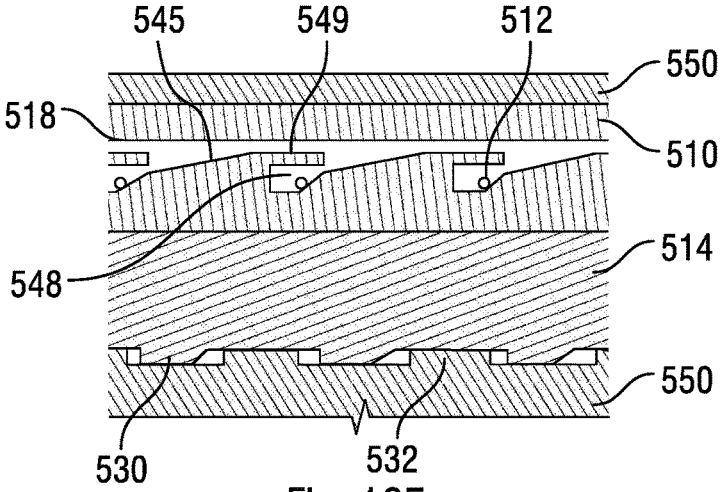
Figure 16F:
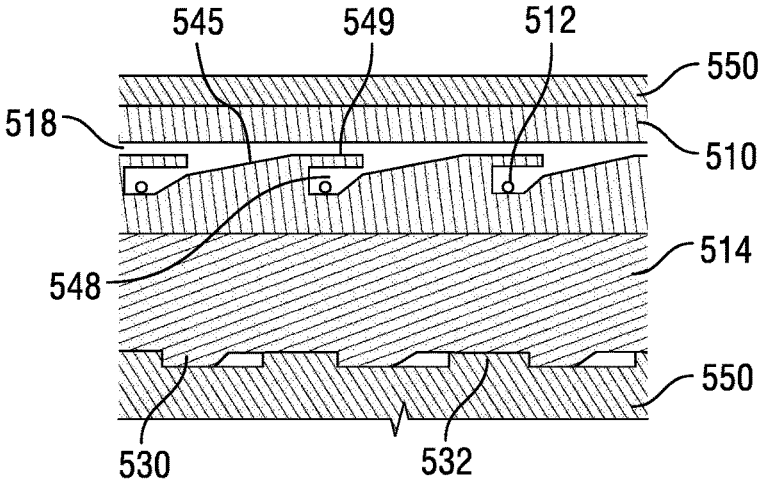

FIGS. 16D-F are roll-out views of an example latching mechanism at successive stages when the drive shaft rotates slower than the bearing housing.

Figure 17:
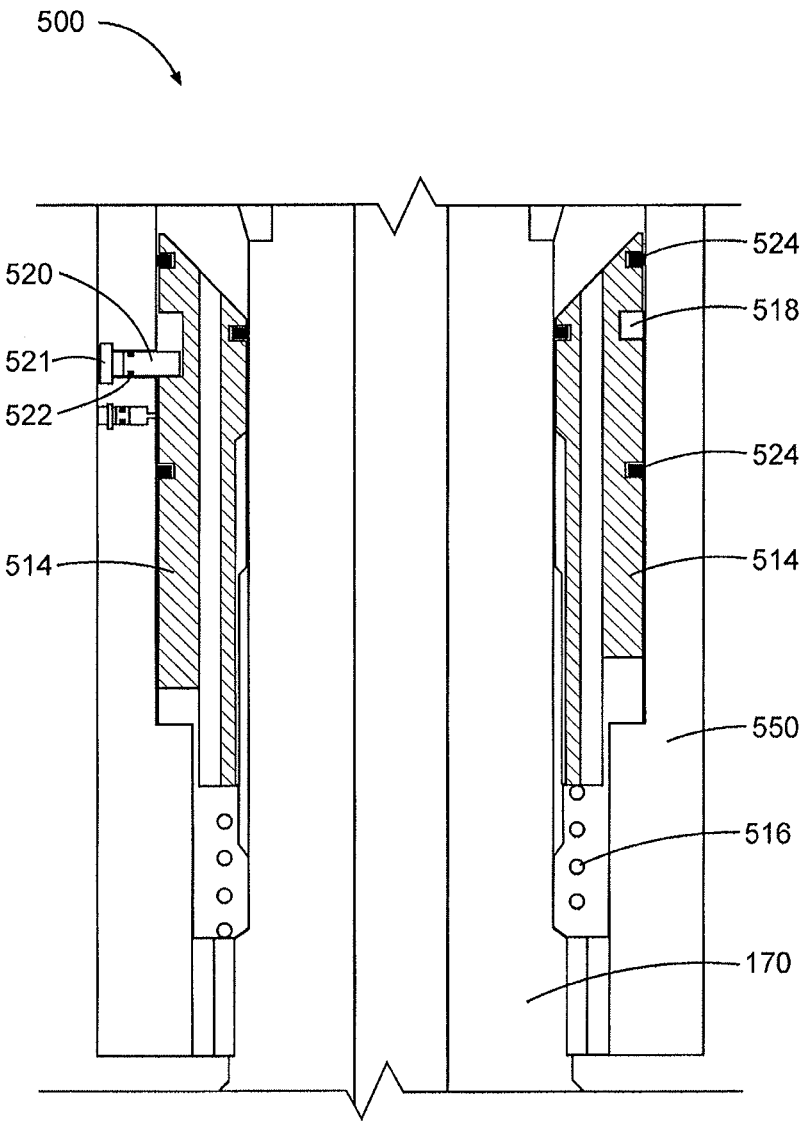

FIG. 17 is a cross-section of latching mechanism, according to aspects of the present disclosure.

FIGS. 18A-18F depict various rotary steerable BHA stack ups, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well drilling and completion operations and, more particularly, to systems and methods of using electric motors to drive a drill bit. Aspects of this disclosure include a drilling system that can create rotational power generated from a device other than a PDM, vane, or turbine motor where hydraulic pressure would be required to generate rotational force to drill the hole.

Illustrative embodiments are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

In one embodiment, the present disclosure provides a pipe-in-pipe electric motor assembly comprising a drilling string comprising an inner pipe and an outer pipe and an electric motor, wherein the electric motor is provided with power supplied by the inner pipe and the outer pipe acting at least as conductors.

In another embodiment, the present disclosure provides a method of providing power to an electric motor comprising providing a pipe-in-pipe electric motor assembly comprising a drilling string comprising an inner pipe and an outer pipe and an electric motor, wherein the electric motor is provided with power supplied by the inner pipe and the outer pipe acting at least as conductors and providing power to the electric motor.

In another embodiment, the present disclosure provides a method of drilling a wellbore in a subterranean formation comprising providing a pipe-in-pipe electric motor assembly comprising a drilling string comprising an inner pipe and an outer pipe; an electric motor; and a drill bit, wherein the electric motor is provided with power supplied by the inner pipe and the outer pipe acting at least as conductors; providing power to the electric motor to generate rotational power; and applying the rotational power to the drill bit.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, or otherwise nonlinear wellbores or construction boreholes such as in river crossing applications in any type of subterranean formation. Embodiments may be applicable to injection wells as well as production wells, including hydrocarbon wells.

The terms "couple" or "couples," as used herein are intended to mean either an indirect or direct connection. Thus, if a first device couples to a second device, that connection may be through a direct connection, or through an indirect electrical connection via other devices and connections. The term "uphole" as used herein means along the drillstring or the hole from the distal end towards the surface, and "downhole" as used herein means along the drillstring or the hole from the surface towards the distal end.

It will be understood that the term "oil well drilling equipment" or "oil well drilling system" is not intended to limit the use of the equipment and processes described with those terms to drilling an oil well. The terms also encompass drilling natural gas wells or hydrocarbon wells in general. Further, such wells can be used for production, monitoring, or injection in relation to the recovery of hydrocarbons or other materials from the subsurface.

Figure 1:
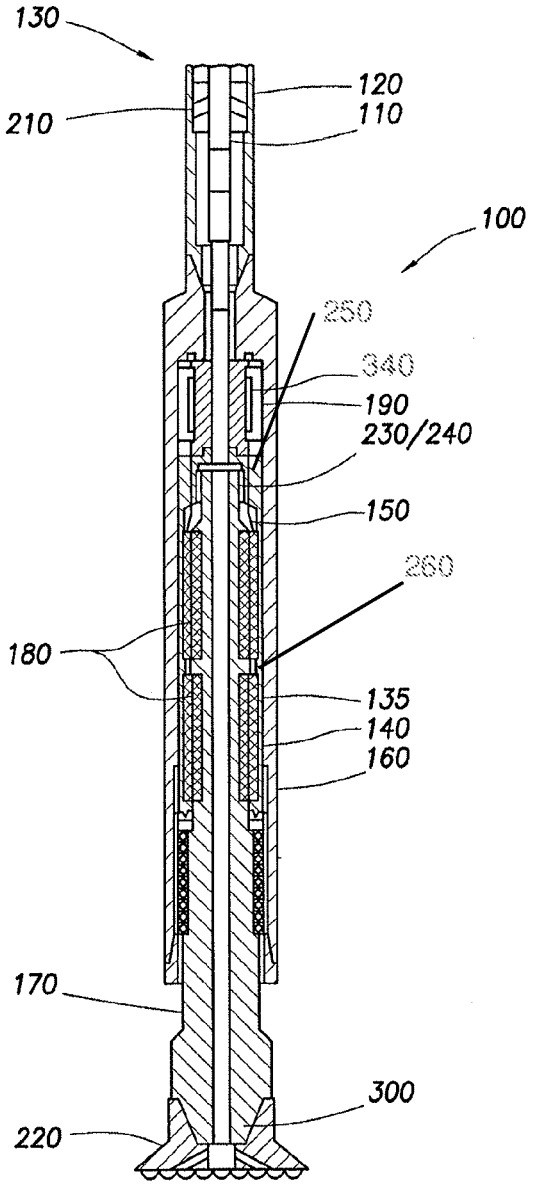
FIG. 1 shows an example layout of a pipe-in-pipe electric BHA motor, according to aspects of the present disclosure.

FIG. 1 depicts an over all layout of a pipe-in-pipe electric BHA motor assembly (100) in accordance to one embodiment of the present disclosure. As shown in FIG. 1, the pipe-in-pipe electric BHA motor assembly (100) may comprise an inner pipe (110), an outer pipe (120), a work string (130), an electric motor (135), stator windings (140), a shell carrier (150), a motor housing (160), a drive shaft (170), drive shaft magnets (180), an electric motor controller (190, a flow diverter (210), a drill bit (220), and a high pressure flow restrictor (230). In certain embodiments, power, preferably direct current power, may be transmitted between the inner pipe (110) and the outer pipe (120) from the surface along the length of the work string (130). In certain embodiments, the inner pipe (110) may be considered the power hot conductor and the outer pipe (120) may be considered the ground. This may be important from a safety stand point to keep the outer pipe (120) as the ground, as it may be conductively connected to the drilling rig and it may be difficult to keep insulated in a drilling environment.

The inner pipe (110) and the outer pipe (120) may eccentric or concentric. In certain embodiments, the outer surface of the inner pipe (110) may be coated with an insulating material to prevent short circuiting of the inner pipe (110) through the mud or other contact points to the outer pipe (120). In other embodiments, the inner surface of the outer pipe (120) may be coated with an insulating material. Examples of insulating materials include dielectric materials. Suitable examples of dielectric materials include polyimide, a GORE™ high strength toughened fluoropolymer, nylon, TEFLON™, and ceramic coatings. In certain embodiments, only in areas sealed and protected from the drilling fluid is the bare metal of the inner pipe (110) exposed to make electrical connections along the length of the work string (130) to the next joint of the inner pipe. Such areas may be filled with air or a non-electrically conducting fluid like oil or a conductive fluid such as water based drilling fluids so long as there is not a path for the electric current to flow from the inner pipe to the outer pipe in a short circuit manner.

In certain embodiments, stator windings (140) may be mounted in a pie wedge fashion within the shell carrier (150). In certain embodiments, the shell carrier (150) may be fixed within the motor housing (160) to prevent the carrier from rotating relative to the work string (130).

In certain embodiments, drive shaft magnets (180) may comprise fixed permanent magnets mounted on the drive shaft (170) in such a manner as to encourage reactive torque from the varying magnetic poles created by the stator windings (140). In certain embodiments, the electric motor (135) may comprise a six pole motor. Several variations in the number of poles and the decision on whether to couple the magnets to the drive shaft verses the housing exists as well as other forms of electric motors such as direct drive motors with a mechanical commutator drive winding arrangement and squirrel cage induction motors that do not use permanent magnets. Single phase motors are possible with the assistance of capacitors to create a pseudo second phase.

In certain embodiments, the electric motor controller (190) may be positioned above the stator windings (140) to control various aspects of the electric motor (135). The electric motor controller (190) can communicate in both directions with the surface through the two conductor path formed by the inner pipe (110) and the outer pipe (120) and through a feed through wire or wires that feed through the electric motor assembly to at least one module positioned below the motor. The at least one module may be downhole tooling, such as a LWD steering system, a MWD steering system, a rotary steerable tool, a hydraulic motor, an under reamer, a telemetry sub, or a drill bit.

In certain embodiments, the electric motor controller (190) may be housed inside a pressure controlled cavity to protect the electronics. The electric motor controller (190) electronics may be coated with a ceramic coating to allow for the cavity to be oil filled and pressure balanced with the annulus allowing for a thinner wall to house the electronics. Advantages of filling the cavity with oil and pressure balancing with the annulus are that the wall thickness to of the electronics cavity to be maintained in a much smaller thickness since it does not have to hold back the entire pressure of the fluid column leaving more space available for the electronics and providing for better heat conduction of heat generated by the electronics to keep it within operable limits.

In certain embodiments, the stator windings (140) may be encapsulated in a ceramic, rubber, or epoxy like potting. This allows the encapsulated region additional short circuit protection that would normally be relegated to the typically peek coating found on the magnet wire which can then be exposed to mud which part of the mud circulates through this region to provide cooling for the windings and power electronics as well as lubricate the mud bearings and radial bearings along the drive shaft (170).

During operation of the pipe-in-pipe electric BHA motor assembly (100), mud may flow down annular spaces formed by the inner pipe (110) and the outer pipe (120). Mud and cuttings may be returned to the surface inside the inner pipe (110). However, near the top of the electric motor (135) this flow regime may change slightly. Flow diverters (210), which are electrically insulated from the outer drill pipe and preferably made of ceramic or metallic with a dielectric insulating coating on the outer surface, allow mud and cuttings from the annulus formed by the inner pipe (110) and the outer pipe (120) to enter the inner pipe while passing downward flowing mud through kidney shaped slots in the flow diverter (210). Below this point, downward flowing mud may be diverted into a center bore where it passes through the inner pipe (110) electrical connection to the electric motor (135) into the motor housing (160). At this point the downward flowing mud may take two separate paths. The first path is down the center bore of the drive shaft (170) and down to the drill bit (220) at the bottom of the work string (130) where it exits the drill bit (220) and begins its way back up the hole to the flow diverter inlet ports. The other path is through a high pressure flow restrictor (230) at the top of the drive shaft (170) then through the space between the outer portion of the rotor and the inner portion of the motor housing and out through the bottom radial bearing assembly just above the shaft bit connection on the bottom of the motor housing. The high pressure flow restrictor (230) may be designed to leak a certain amount of drilling fluid to flow through into the motor housing (160) to cool the stator windings (140) and to lubricate the radial and axial bearings of the electric motor (135). The high pressure flow restrictor (230) may also double as a radial bearing (240). In other embodiments, a separate radial bearing (240) may exist. The radial bearings (240) may comprise rubber marine bearings, PDC bearings or various hardened coatings like fused tungsten carbide.

High pressure flow restrictor (230) may be positioned anywhere along the flow path as long as the flow is restricted somewhere along the path of the top of the drive shaft and the bottom of the motor housing. In certain embodiments, the high pressure flow restrictor (230) may be positioned directly below the upper radial bearings (240) as it is easier to work with such a device and it also acts as a filter keeping larger solids that happen to get into the mud away from the stator windings (140) and the radial bearings (240).

Figure 2:
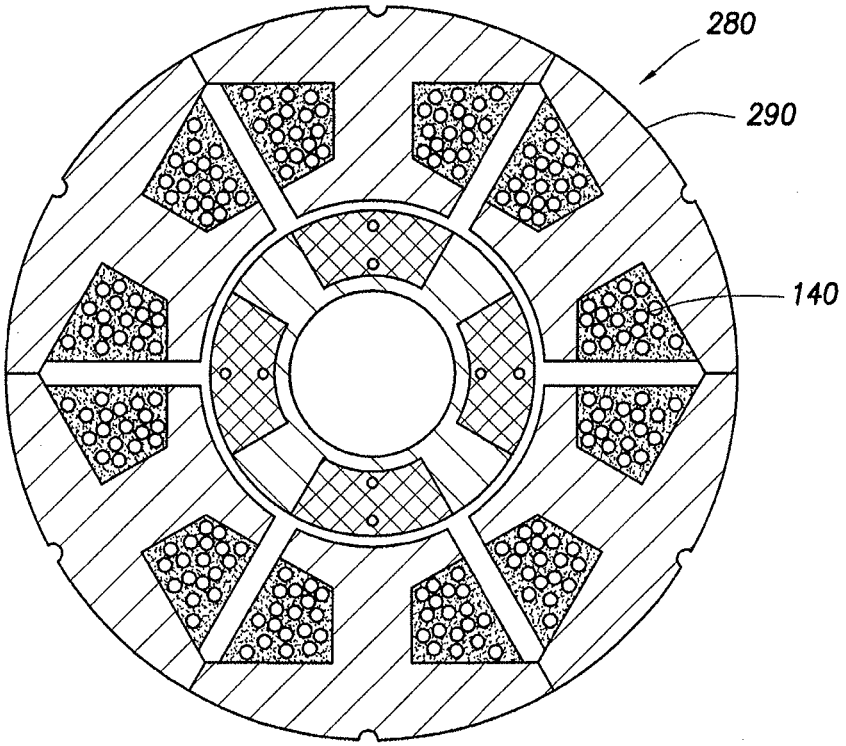
FIG. 2 shows an example cross-sectional view of a rotor and stator of the electric motor, according to aspects of the present disclosure.

FIG. 2 depicts a cross section of a rotor and stator without the winding carrier sleeve (250) or the motor housing (160). In this example, a six pole stator winding assembly (280) is shown. The stator windings (140) may wrap along one or more stator heads (290). In certain embodiments, the one or more stator heads (290) may comprise long rectangular pie wedges. The one or more stator heads (290) may be made of a soft iron with a high permeability. The one or more stator heads (290) may contact each other or may be welded together.

In certain embodiments, a stator head assembly may be made out of one round bar by using machining methods such as electrochemical machining, wire EDM, or electrode electro-static disgorge machine machining or extruding the shape so that the outer diameter of stator head assembly is one solid diameter rather than six individual pieces. In certain embodiments, the stator winding assembly (280) may be made up of six pieces to reduce manufacturing costs. In the case where the stator heads are made out of one bar, the stator windings may be threaded through the various passages. In certain embodiments, the encapsulated coating may be injection molded into the inner area and ends. The stator may be coated to reduce corrosion and increase its useful life but in this case the potting material could suffice for this role. In certain embodiments, the potting material can be made of various compounds such as epoxy, ceramic based compounds, nylon, or peek like polytetrafluoroethylene such as Arlon 100 from Greentweed.

In the pie wedge concept illustrated in FIG. 2, the stator heads may corrode when exposed to many types of mud systems if the pie wedge contact area near the outer diameter is not coated with a protective material. However, a very thin corrosive resistant coating may be applied to the stator heads at the outer diameter points of contact to limit magnetic flux linkage losses while applying a heavier coating to the parts of the stator head exposed to flowing mud.

The stator windings (140) may be varnish, peek or other dielectric type coated magnetic wire ideally made of silver, copper, aluminum, or any conductive element, including high temperature super conductor materials. The stator windings (140) may make several wraps around the stator heads (290). Optionally, over top and embedded into the stator windings (140) may be a potting material. In certain embodiments, the potting material may be a ceramic or more flexible high temperature epoxy. This material may be used to protect the stator windings (140) from corrosion from the mud and erosion protection, including from fine sands that can make their way into this area.

The one or more stator heads (290) may be grooved on the outer diameter and may be keyed with the shell carrier (150) to hold the one or more stator heads (290) still from the torque generated. This torque may then be carried to the motor housing (160) through additional spline grooves in the carrier housing (260) and the splines on the motor housing (160). Other ways of doing this are easy to understand by those skilled in the art with the benefit of this disclosure.

Optionally the carrier housing (260) outer diameter and the motor housing (160) inner diameter may be slightly tapered, narrowing toward the top, to allow for a snug fit and prevent mud fines from building up between the motor housing (160) and the carrier housing (260). In this manner the winding carrier sleeve (250) may be pulled or pressed out. The top of the winding carrier sleeve (250) may have additional anti-rotation keys that engage the electronics insert and/or the additional spline grooves that engage the splines located in the motor housing (160).

Figure 3:
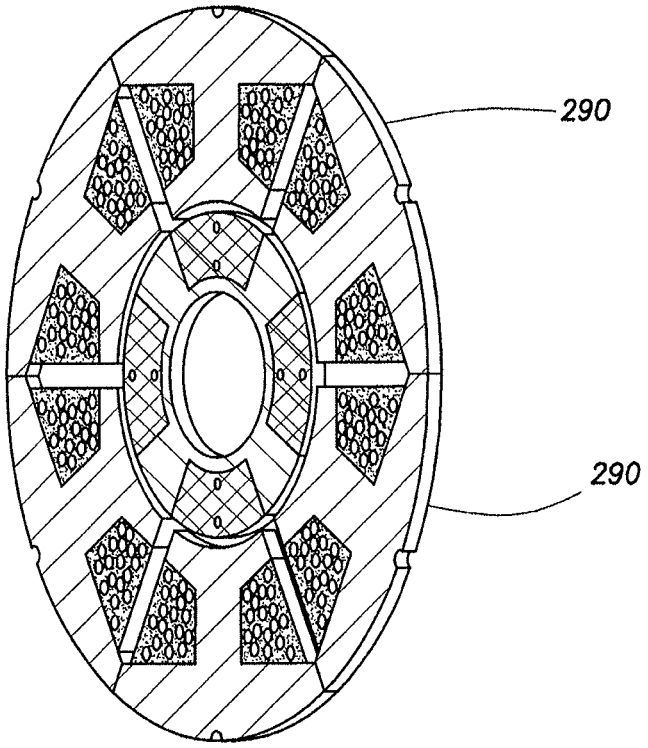
FIG. 3 shows a cross-sectional slice of a stator and rotor, according to aspects of the present disclosure.

In certain embodiments, the one or more stator heads (290) may be made with thin slices of the cross section. As shown in FIG. 3, the shape of the one or more stator heads (290) may be stamped from thin sheets of iron, coated with a thin insulated and stacked one on top of each other in the carrier then threaded with the winding. This is because long solid bars of the one or more stator heads (290) along the length of the electric motor (135) may create large eddy currents that hamper motor efficiency and create heat. The wires extend along the length of the stator head slices uninterrupted winding around the group of stator head slices.

By using thin stamped sheets, the problems mentioned above with manufacturing costs and assembly issues may be solved while still providing for a power stator design. In certain embodiments, each stator slice may be about 1/16"-1/4" thick. Alternately each individual stator head can be stamped out thus needing six stamped pieces to make one layer, arranged as shown in FIG. 2.

Referring again to FIG. 1, the drive shaft (170) may run out the bottom of the electric motor (135) to thread into either the drill bit (220) or other BHA components. While a pin end connection (300) on the drive shaft (170) is shown in FIG. 1, a box connection may replace the pin end connection (300) in certain embodiments. One or more drive shaft magnets (180) may be mounted on the drive shaft (170). FIG. 1 depicts four drive shaft magnets (180) mounted on the drive shaft (170). While there are other ways of making a rotor for an electric motor, such as, for example, a squirrel cage induction motor, this method of permanent magnets offers a great deal of torque delivery and mechanical stability. The drive shaft magnets (180) may be arranged to be optimized for a three-phase motor. With the benefit of this disclosure, those skilled in the art of will recognize this motor operates by pushing and pulling the shaft magnets with the electro-motive force of the stator by varying the phase of the current passing through the six windings. At higher temperatures of operations, windings may be used instead of magnets on the drive shaft to facilitate torque transfer much like a squirrel cage motor. The primary limit of the magnets may be the curie temperature where the magnetization of the magnet is lost or at least a significant reduction in the pole strength of the magnet may occur.

The motor may be controlled with solid state switches rather than using a commutator. While a commutator may work it is not ideal as it must use brushes in an electrically insulated environment, which would mean an oil filled cavity with a rotary seal for a barrier to the mud would be necessary which can be problematic for reliability and maintenance reasons if the rotary seal has to operate at high RPMs over long hours as is the case here.

Referring again to FIG. 1, the pipe-in-pipe electric BHA motor assembly (100) may further comprise an electronics insert (340). The electronics assembly (340) may have a processor with memory for monitoring and controlling the electric motor (135). The processor may provide several functions, including, but not limited to, motor start up control; capacitors to aid start up and operation; power consumption monitoring; motor speed control (which may be managed through the frequency applied to the windings and the current allowed to flow in those windings); motor toque output control (constant or variable torque delivery); power control; motor temperature control (the stator windings may be embedded with temperature sensors); transmission of motor and BHA sensor data to the surface through the pipe-in-pipe conductors; receipt of motor parameter commands such as speed, torque, and power output limits; data queries and other forms of requests from surface over the pipe-in-pipe conductors; stall detection and recovery; slip stick detection; and a closed loop response to managing the stick slip to maintain the motor drilling conditions in a more favorable range. The system automatically detects and stays away from bad drilling parameters and learns what drilling parameters are unfavorable as drilling proceeds. The system may detect stalling conditions and limit power delivery to the windings, essentially shutting down the motor, if the applied force on the motor increases beyond a threshold level and the shaft RPM drops below a threshold level, which could potentially cause damage to the motor windings through an increase in current circulating through the motor windings.

The processor may receive weight and torque data from the surface or from a down hole sensor located in the motor or embedded elsewhere in the drill string. The processor may use this data to determine when to power down the motor prior to the motor experiencing damaging stall rotation rates. The processor may then restart the motor with short test durations to determine if the applied load has been relieved and/or sensor information from the weight and torque sensors indicating the motor is safe to operate. Further, the electronics may contain current limiting circuitry so as to limit the amount of current that may be applied to the motor winding coils. The processor may record and monitor RPM, applied power, and weight and torque on the bit to determine if a degradation in motor or bit performance has occurred. The processor may also notify a computer at the surface of a change in condition. For example, if the applied power to the motor remains constant but the torque applied to the formation decreases, a degradation in the bit or motor performance may be indicated. In certain embodiments, data may relayed to surface in real-time, using the telemetry system. Such data could be used, for example, to calculate the mechanical efficiency of the drill bit and monitor the drill bit for signs of wear. In addition, the mechanical efficiency and/or the torque and weight data can be compared against the earth model from offset wells in the area to determine the optimal weight applied to the bit and the required torque from the electric motor to obtain increased drilling performance for the drilled formation.

Any form of electric power may be used to drive the motor. In certain embodiments, DC power may allow for greater power control of downhole electronics. In certain embodiments, three-phase power may be transmitted from surface to the motor downhole.

Figure 4:
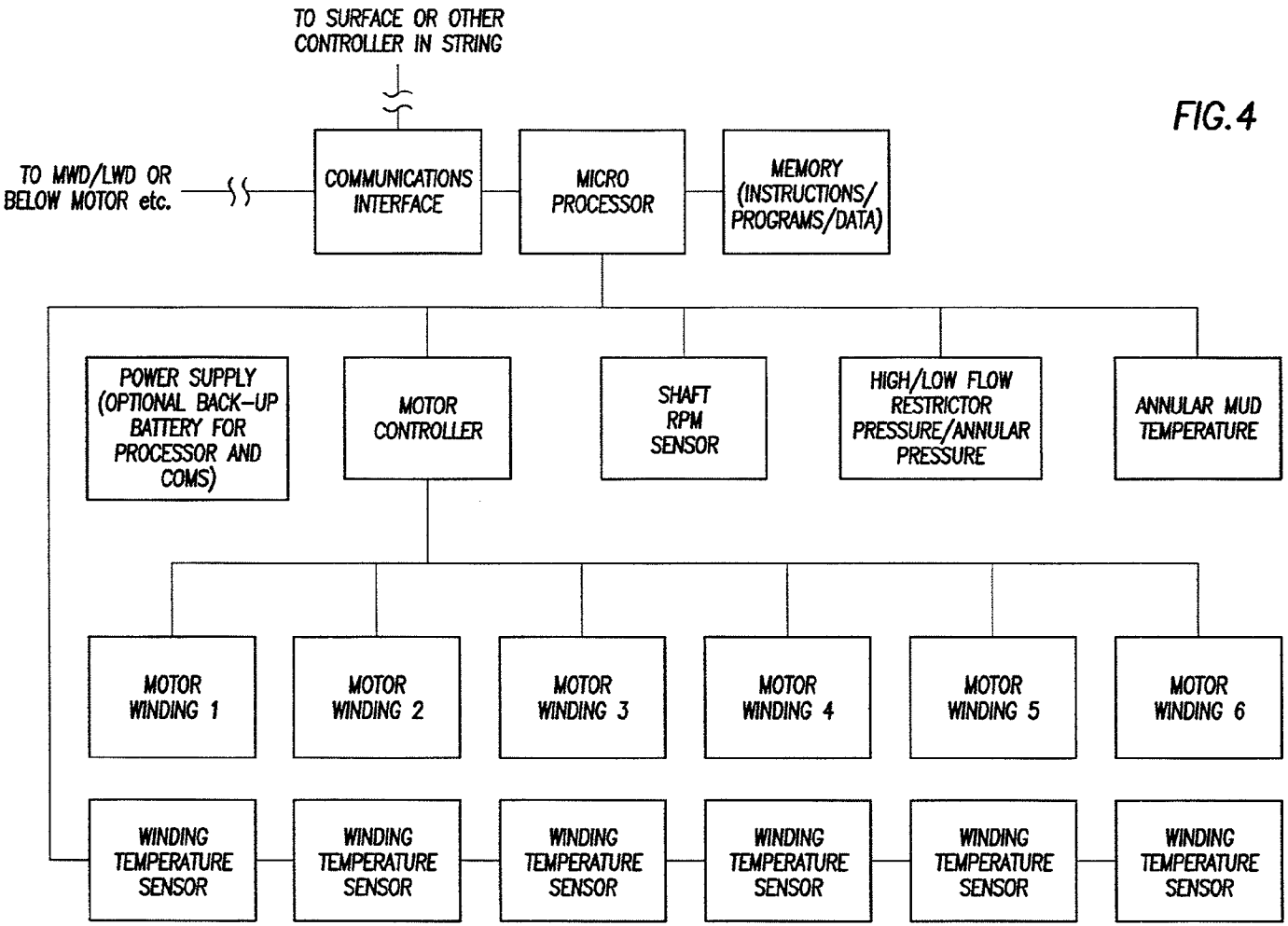
FIG. 4 shows an example block diagram of the motor electronics, according to aspects of the present disclosure.

A generalized block diagram is shown in FIG. 4, which details the communications, sensors, and motor control elements of the system. While not shown in FIG. 4, communications may also be included through the bottom of the motor or both upwards and downward directions in the string. Such means may be through the use of slip rings or inductive couplings and are known to those skilled in the art. The slip ring or inductive coupling may allow the communication and/or power to jump in either direction between the motor housing and the rotating drive shaft. End point connectors with electrical conductors may provide a signal pathway to the motor where communications can continue onto the next module. The connection on the top of the motor may be through a communications interface that couples into the power delivery of the two pipe conductor.

In certain embodiments, the communications channel can be in direct communications with the pipe-in-pipe communications network or communicate with a local network such as one for an MWD/LWD system, a near bit or in bit communications node, or a plurality of networks and communication nodes. The processor may execute commands that are stored in a memory storage area, which could be embedded in the processor itself or in a separate memory element. The memory may also be used for logging performance information about the motor such as winding temperature, tool temperature, mud temperature, shaft RPM, power output, torque output, system current, voltage and power, winding current, voltage and power input, and pressure on either side of the high pressure flow restrictor to watch for wash out indications and ensure a steady flow of mud through the windings. The power supply may supply power from the pipe-in-pipe conductors. Since the pipe-in-pipe conductors may be used to power each element of the drilling system, no connected lines are shown in FIG. 4. The pressure sensors may also be used to detect an absence of fluid flow to protect the motor from over heating.

In addition, in the event of a power failure to the motor, one or more batteries, rechargeable batteries, or capacitors may be used to provide power to the communications, sensors, processor, memory modules, and/or any other electronic device in the tool. Low power communications with the motor may continue even if the amount of power supplied to the system is insufficient to power the motor's electrical windings to drill the hole. As such, the system to stay responsive to communications and other electronic functions, such as logging data from sensors, while power is reconnected.

The use of batteries may also allow communications and sensors to be kept alive to exchange data and commands while a connection is made on the surface or another rig operation takes place. In addition, communication between various network nodes in the work string may be maintained to monitor downhole sensors in the event surface communications are inactive.

DC power may be converted to three-phase current by the motor controller. In certain embodiments, the motor controller may use solid state electronics to switch on current to windings and flip the polarity of the windings to replicate three-phase power from the surface. Current to the six windings may be managed in three pairs, where the current in any pair may be nearly the same at any given moment of time save for minor lag effects. The winding pairs may be opposite to each other in the motor as shown in FIG. 2 where the phase relationship of each winding pair shown in FIG. 5 may be 120° out of phase with any adjacent winding pair.

Figure 5:
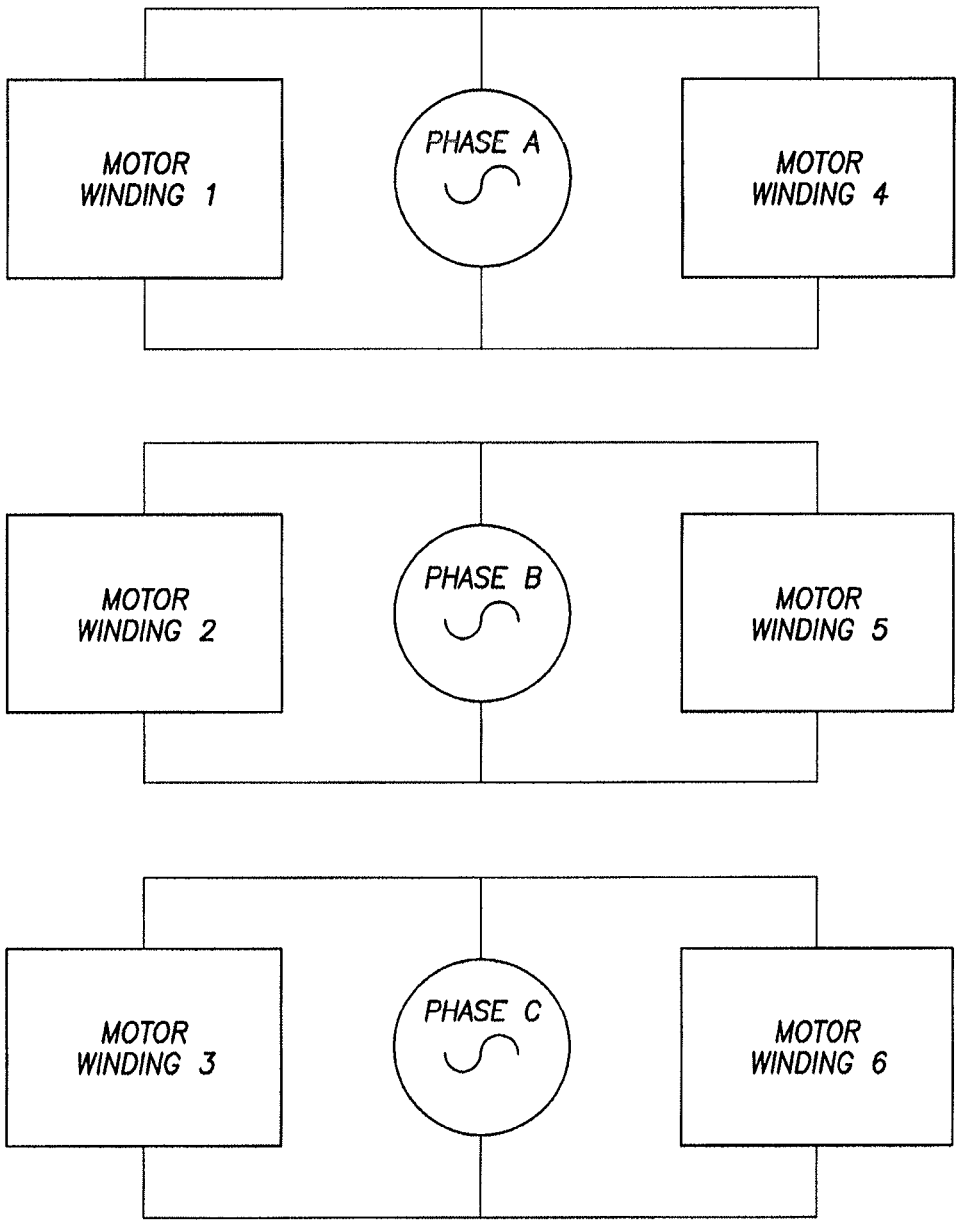
FIG. 5 shows an example block diagram of winding pairs, according to aspects of the present disclosure.

The phase relationships between the three phases may be controlled by a master controller to ensure all three phases remain in sync at 120° separation in phase. In order to maximize power transfer to the rotor, a sinusoidal or other wave shape for the three phase controller may be generated to power the three pairs of windings. In certain embodiments, the windings may be connected in parallel, to reduce series resistance of the winding pairs. The windings and current flow may be timed such that each stator pole matches the orientation of the other winding in its pair. This means that the inner tip of each stator pole pair may have the same magnetic field polarity such as North, South or neutral. In embodiments where each coil is wrapped identically for each winding, each phase pair may be wired in parallel as shown in FIG. 5.

Functions of the motor controller may include: switching polarity directions in sync with the desired rotation direction; maintaining phase separation of each winding pair; maintaining the applied frequency and ramping the frequency up and/or down at acceptable rates for the motor based on changes in desired motor speed; and maintaining power levels to the windings to optimize torque delivery for the desired speed. Each of the motor controller functions may be accomplished by varying the supplied current, voltage, or both, to the winding pairs and/or varying the duty cycle of each wave. In addition, start up capacitors may be employed to aid in speeding up the motor. These capacitors may be switched out by the motor controller as the motor reaches about 75% of its rated speed.

It should be noted that in some embodiments, the controller may alter the phase of any two channels (A and B, B and C, or C and A) to change the direction of rotation of the rotor while still being able to output the same amount of torque and power to the bit. This may provide an improvement over traditional PDM motors that rotate in only one direction. The ability to reverse rotation may assist in freeing a stuck drill bit, disconnecting a rotary connection to leave a stuck fish in the hole and release the BHA, drilling in the opposite direction using bit cutters pointing in the opposite direction, extending the life of a roller cone bit by stressing it in the opposite direction, and/or activating another mechanical mechanism.

The motor controller may vary the power to each winding pair in a square wave, sinusoidal wave, another cyclical wave form method. In certain embodiments, the electronics may be designed with solid state switches such as variacs or relays to vary the direction of current flow through the windings from the DC source.

Figure 6:
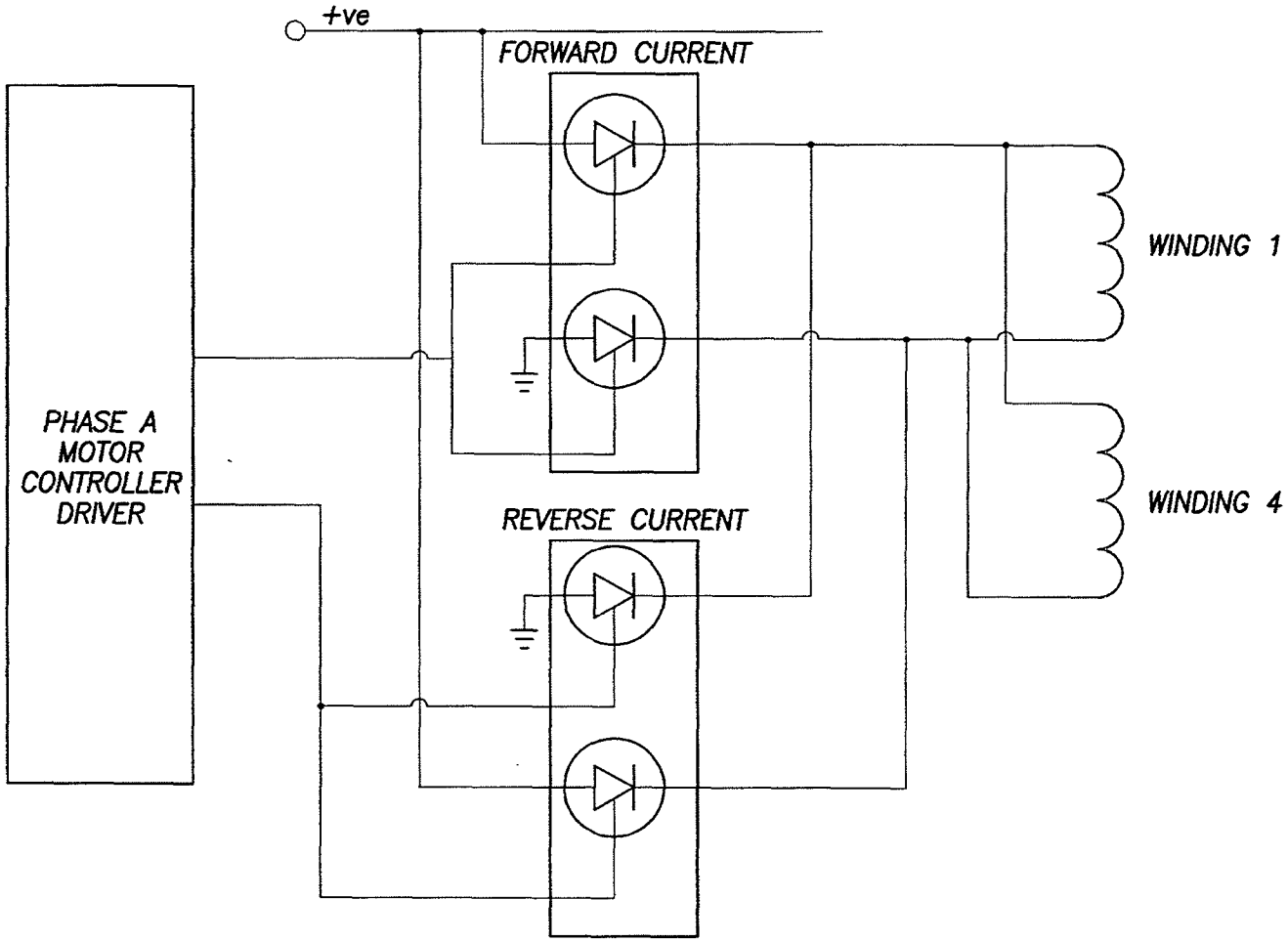
FIG. 6 shows an example electronics schematic, according to aspects of the present disclosure.

In one embodiment, a time varying signal may be emulated to engage the windings with square wave electrical pulses in opposite polarities. The average power consumed by the motor per rotation may be varied by adjusting the phase and duty cycle of each square wave. Such a method may be accomplished using semi-conductor based switches such as silicon controlled rectifiers (SCR), thyristors, or other forms of switching devices. Other methods may include using transformers to vary the power applied to the motor windings. Such transformers could include variacs, step up, step down, and/or multi-tap transformers. FIG. 6 shows an example arrangement of switches fired on and off by the controller to vary both the polarity and duty cycle of power applied to each winding pair. A timer in the motor controller microprocessor may maintain the pulse width and phase of all three channels and ramp up or down the overall frequency as desired. The arrangement depicted in FIG. 6 may be replicated for each of the winding pairs. The motor controller may receive commands from the surface or from the local processor managing other functions of the motor. The instructions and/or control parameters in memory may also be programmed over a downlink communications channel while the motor is down hole.

In certain embodiments, the motor driver may be a small power amplifier switch used to source enough power to turn the semi-conductor switch on and off and may switch on or off based on logic outputs from the processor. In certain embodiments where the processor has the power to turn on and off the switches, the digital outputs or analogue outputs of the process may be attached directly to the switch control lines. The process may alternate between switch pairs to reverse the current through the winding pair or switch both switch pairs off when required by the phasing and duty cycle time.

Returning again to FIG. 1, the drive shaft magnets (180) may be of a high magnetic field strength. Suitable types of drive shaft magnets (180) may include Samarium Cobalt magnets. In certain embodiments, drive shaft magnets (180) may be manufactured in a wedge shaped mold to match a pocket on the drive shaft (170). In certain embodiments, the drive shaft magnets (180) may be made by pouring a loose powder of fine particles into a mold that may then be pressed and sintered in the mold. A weak magnetic field may be applied during this process to align the magnet poles across the thickness of the long bar to the optimal magnetic field orientation for application. The shape of the magnet may be a semi-wedge, rectangle, triangle, or any desired geometric shape. Once the drive shaft magnets (180) are set, they may be fastened into the drive shaft (170), if not sintered in place, through various means such as retainer bands/sleeves, screws slots or other fasteners.

The polarity of the drive shaft magnets (180) may be alternated with the North pole (N) facing out then the next magnet polarized or oriented with the South pole (S) facing out, then North again and lastly South for the four pole rotor example. The number of windings and magnets may be multiplied, such as using twelve stator poles and eight rotor magnets or three stator poles and two rotor magnets.

Figure 7A:
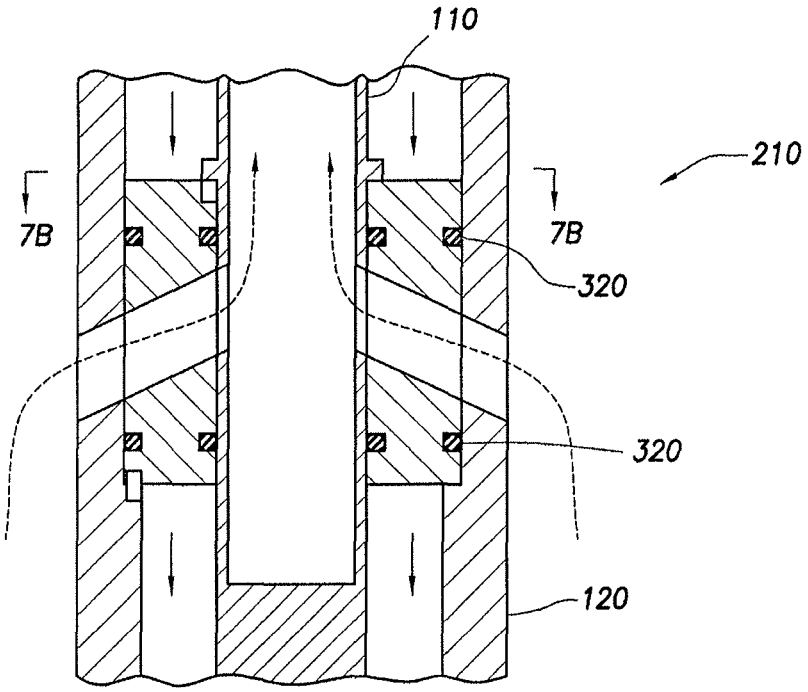
FIG. 7 shows an example layout of a flow diverter within a pipe-in-pipe system, according to aspects of the present disclosure.
Figure 7B:
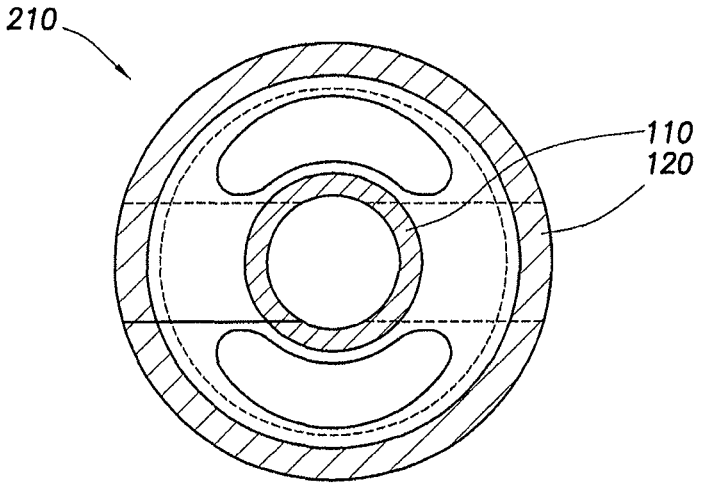

Referring now to FIGS. 7*a* and 7*b*, a view of the upper portion of FIG. 1 is shown. In certain embodiments, the flow diverter (210) may be made of an electrically insulating material, such as a ceramic. Ceramics offer a high erosion resistance to flowing sand, cuttings, junk, and other solids flowing from the annulus to the inner bore of the inner pipe on the flow return path to surface. In certain embodiments, the flow diverter (210) may be a diverter ring. In certain embodiments, the diverter ring may not be ceramic so long as the inner pipe is insulated from any conductive material used for the diverter. Seals (320) may be located on the top and bottom of the flow diverter (210) to prevent annular flow between the inner pipe (110) and the outer pipe (120) from leaking into the center of the inner pipe (110). As mentioned above, annular flow may come down from the surface, pass through the slots in the flow diverter (210), and pass onward down through to the motor area and eventually to the end of the drill string. In certain embodiments, the flow diverter (210) may be keyed to the inner pipe (110) and the outer pipe (120) to maintain its orientation with the holes in the inner pipe (110) and the outer pipe (120).

Figure 8:
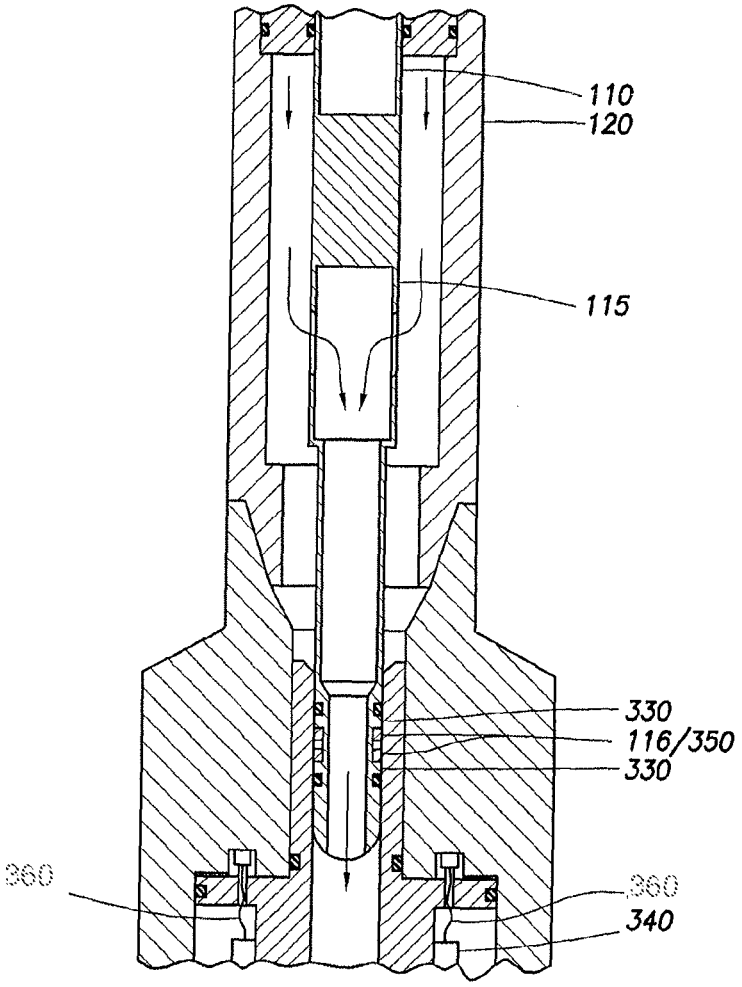
FIG. 8 shows an example layout of a pipe-in-pipe electric BHA motor, according to aspects of the present disclosure.

FIG. 8 depicts how the flow between the inner pipe (110) and the outer pipe (120) may be diverted into the inside of the inner pipe (110) to the center section of pipe (115), which is not in fluid communication with the other section of the inner pipe (110). This allows the flow to divert downward through the center section of pipe (115) to the BHA and to the drill bit (220). In some embodiments, the inner pipe (110) may have an electrically insulated coating in all places except a conductive area (116). In the conductive area (116) there may be a short exposed metal section of the inner pipe (110) is mated with an electronics insert (340) to facilitate the transfer of electrical power to the electric motor controller (190). The electronics insert (340) may have an exposed section that is not electrically insulated. A conductive wire wound spring (350) may be used to maintain connection in a sealed wet connect area (330). The electronics insert (340) may have two ground lines (360) that return the electrical path to the outer pipe (120) once the current passes through the various electronic and motor components. While not shown, the flange end of the electronics insert (340) may have orientation dowels and extra dowels to brace it against any torsional forces it may experience or other mechanical means of retention to prevent rotation. The ground connections of grounds lines (360) may be sealed from the mud to ensure the connectors do not become damaged from corrosive mud conditions. The mud may flow down the center of the electronics insert (340) and up the outside of the motor housing.

Figure 9:
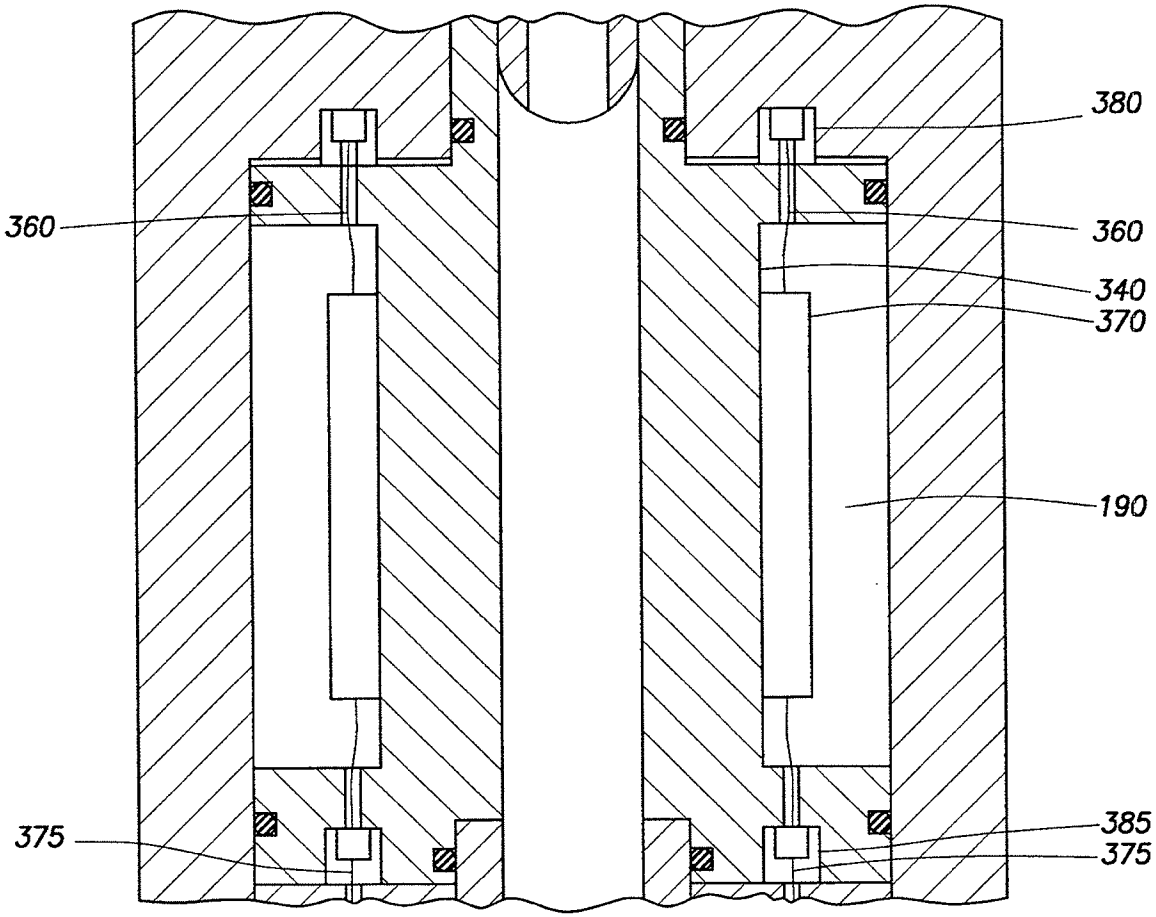
FIG. 9 shows an example layout of an electronics insert, according to aspects of the present disclosure.

FIG. 9 depicts the electronics insert (340), according to aspects of the present disclosure. As mentioned above, the electronics insert (340) may house one or more processors and power control electronics (370) to control the electric motor. Wires (375) may lead out to the stator windings and sensors (385) through sealed bulkhead interfaces (380).

Figure 10:
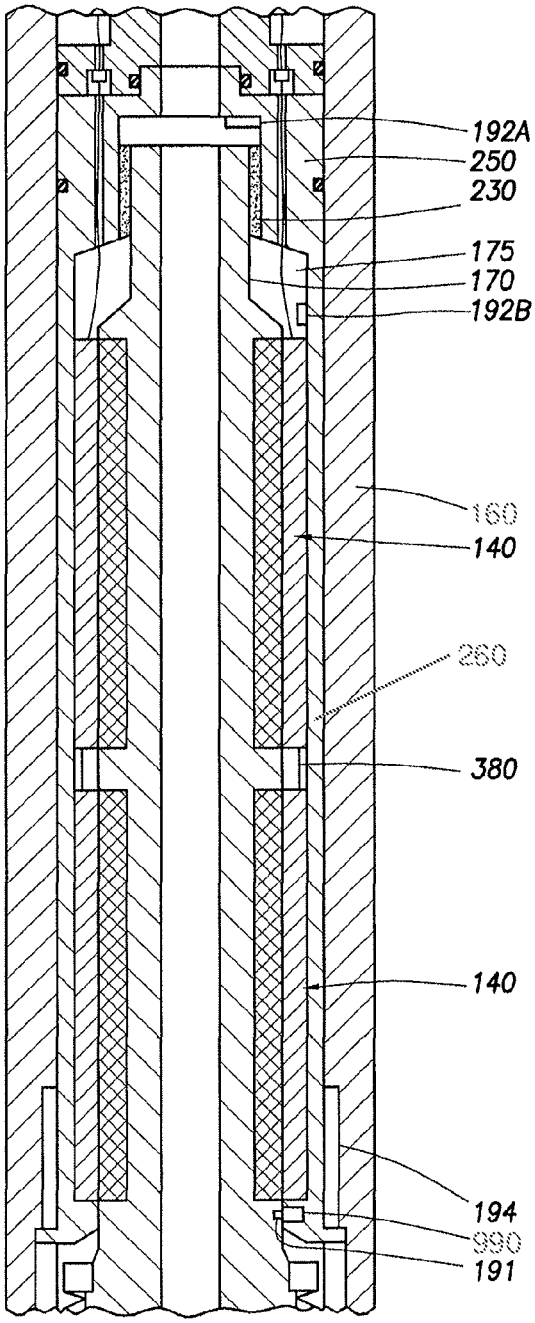
FIG. 10 shows an example layout of a pipe-in-pipe electric BHA motor, according to aspects of the present disclosure.

FIG. 10 shows the primary motor winding and drive shaft area. A high pressure flow restrictor (230) may be located at the top of the motor winding and drive shaft area. The high pressure flow restrictor (230) may also operate as a radial bearing and with a small gap flow path to allow mud flow. The high pressure flow restrictor (230) may be made of a high erosion resistant material, such as tungsten carbide or a cobalt based alloy like Stellite. The high pressure flow restrictor (230) may allow some mud to leak into the outside of drive shaft (170) to pressure balance the winding area (175) and flow mud through the windings to keep them cool. As depicted in FIG. 10, there may be two sections of stator windings (140) but a single winding section or a plurality of winding sections may be used to optimize the desired torque.

In certain embodiments, hall effect switches (990) may be embedded in the winding carrier to monitor shaft position and RPM by observing small magnets (191) or the rotor magnet relative position on the shaft. The signal output of the hall effect switch (990) or other RPM sensor may be routed back to the motor control electronics high pressure flow restrictor (230) where the processor can automatically measure and adjust the speed of the motor based on the sensor feedback. Other types of position sensors may also be included in the winding carrier, such as proximity sensors. By monitoring the shaft position while it rotates, one can better optimize the torque delivery to the motor and watch for pole slippage, which may occur if the torque from the bit reaction of drilling exceeds the stall point of the motor, or chatter, which might mean one the windings are applying torque in an uneven manner, and thus allow adjustment of the applied torque output of the windings to obtain as even a torque output as possible. In certain embodiments, temperature sensors may also be embedded in the carrier or adjacent to the windings. In certain embodiments, at least one temperature sensor for each winding may be used to monitor the motor temperature. Furthermore, in certain embodiments, a pressure sensor may be installed in the carrier above (192A) and below (192B) the high pressure flow restrictor (230) to monitor the performance of the flow restrictor to make sure a wash out or a plugging is not occurring and to confirm that the mud pumps are operating to cool the motor.

In certain embodiments, a radial bearing support (380) may be located between the two winding and drive shaft winding sections, which may be mud lubricated. In certain embodiments, an elastomeric marine bearing, roller, ball, journal, or other bearing style may be used. The stator winding carrier has spline grooves (194) to mate with motor housing splines to keep the winding carrier from rotating.

Figure 11:
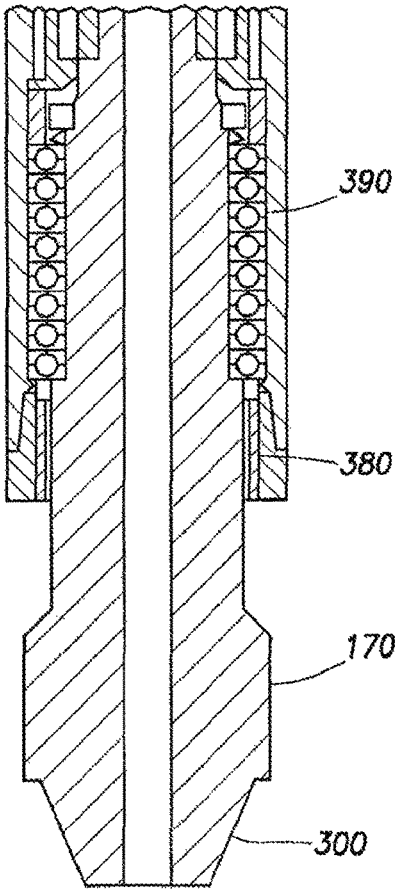
FIG. 11 shows an example bearing pack layout, according to aspects of the present disclosure.

FIG. 11 illustrates an axial load bearing pack configuration that may allow on and off bottom rotation of the drive shaft (170) and may have a radial bearing support (380) at the bottom. The drive shaft (170) may have a pin end connection (300) or a box connection. Other variations of this downhole electric motor may be possible. For example, the drive shaft (170) may be split into two sections where a torsion rod or universal coupling may connect the two draft shaft sections through an adjustable or fixed bent housing. The bearing pack may reside above or below the bend, or above the motor section. An adjustable bent housing may be surface or downhole adjustable meaning the housing may adjust the tilt angle of the lower end of the drive shaft away from the axis of the tool to at least one angular position. In certain embodiments, thrust bearings (390) may reside above any bent sub assembly.

In certain embodiments, the electric motor (135) may have an interface module that facilitates coupling, communication, and/or power transmission continuity to the surface with the drill pipe. The electric motor (135) may be controlled from surface communication signals. The electric motor (135) may also send monitoring signals to the surface. The electric motor (135) may have variable speed and/or torque capabilities. A gear reduction or planetary gearing in conjunction with a variable speed electric motor may be utilized to facilitate desired speed and torque output.

The electric motor may be a modular component of a bottom hole assembly or be utilized stand alone. The electric motor may be utilized to enlarge or ream the wellbore with or without drill string rotation as supplied from surface equipment. The electric motor may have multiple configurations to facilitate adaptability to desired rock cutting and/or destruction mechanisms. These configurations may include laser drilling and/or laser drill bit assist, Polycrystalline Diamond Compact (PDC) cutting structures on fixed cutter bits, roller cone bits, pulsed electric rock drilling apparatus, and/or other rock destruction devices.

Rotation for the cutting assembly may be provided and/or supplemented by the rotation of the drill string from surface equipment. The cutting structure on the cutting assembly may have a depth of cut (ultimate diameter) powered by an independent electric motor that controls ramps or pistons. When cutting rotation is not desired the cutting structures of the cutter assembly may be retracted, the modular motor assembly can be commanded to shut down, and, if necessary, the cutter assembly rotation may be locked. In certain embodiments, reaming may be optimized by allowing the individual cylindrical reaming cutting assemblies to rotate on their own arbors.

Figure 12:
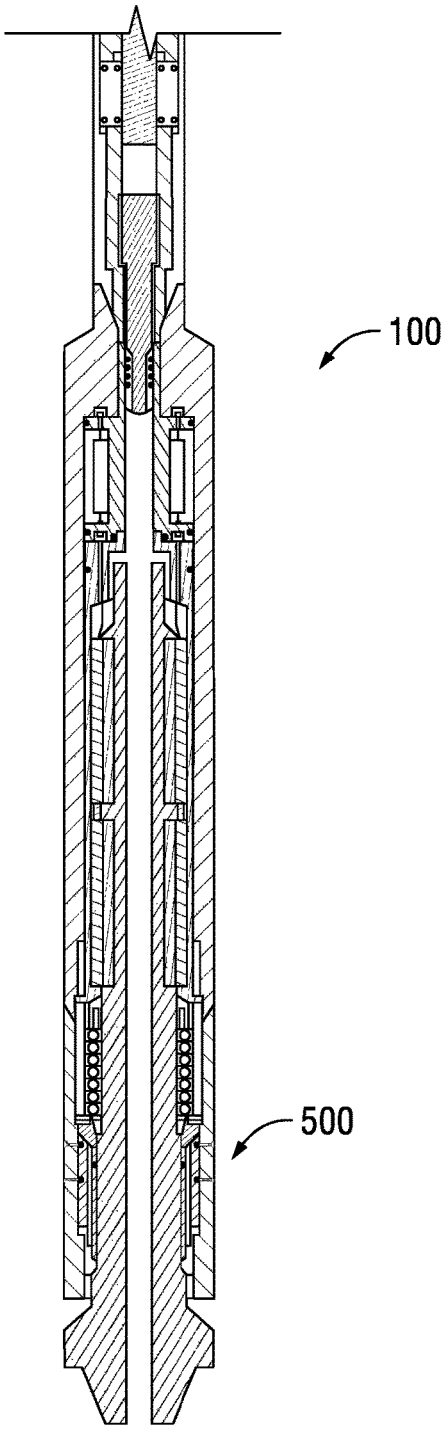
FIG. 12 shows an example layout of a pipe-in-pipe electric BHA motor comprising a latching mechanism, according to aspects of the present disclosure.

Referring now to FIG. 12, a pipe-in-pipe electric BHA motor assembly (100) in accordance to one embodiment of the present disclosure is shown, including a latching mechanism 500.

Figure 13:
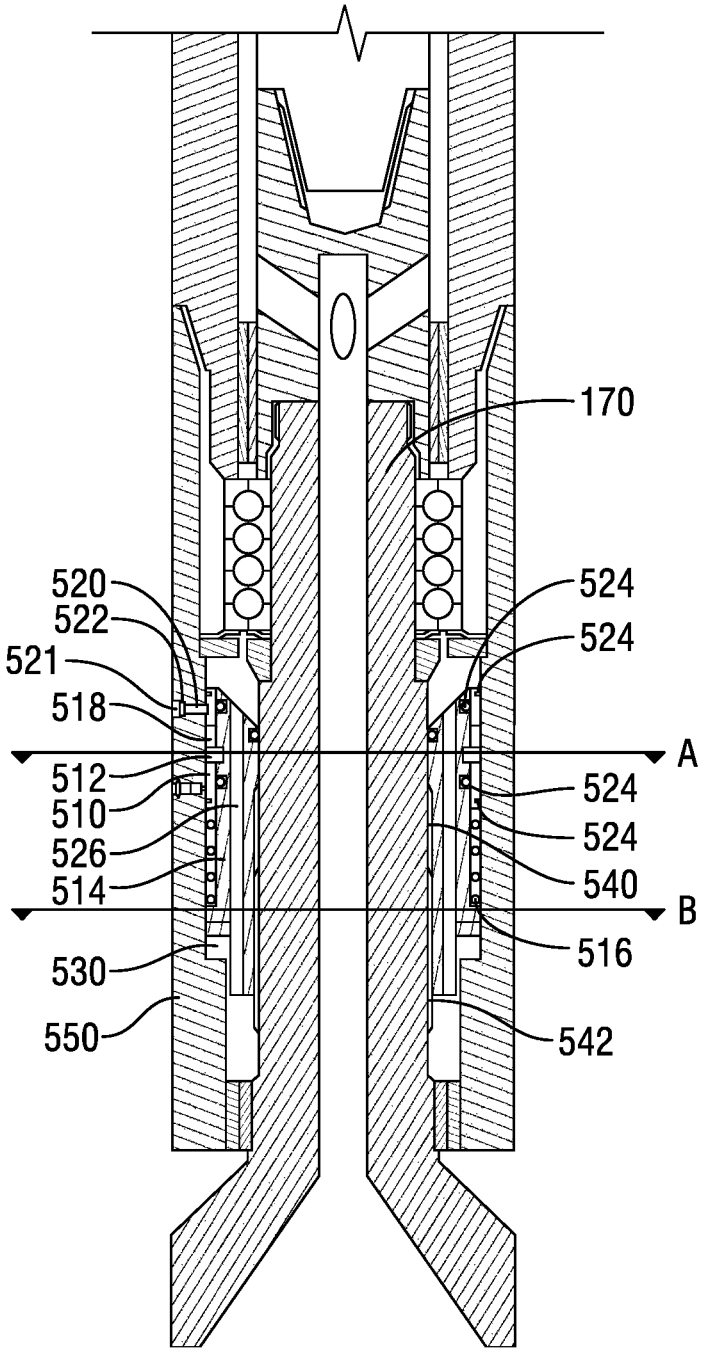
FIG. 13 is a cross-section of an example latching mechanism disposed between a drive shaft and a bearing housing, according to aspects of the present disclosure.

Referring now to FIG. 13, a close-up cross-sectional view of an example latching mechanism 500 is shown disposed between the drive shaft 170 and a bearing housing 550 of the motor, according to aspects of the present disclosure. The latching mechanism 500 may be any mechanism that allows selective rotation of the drive shaft 170 in one direction compared to the bearing housing 550. The latching mechanism 500 is shown placed adjacent to a bearing pack in the drill string; however, the latching mechanism 500 may be placed at any point on the drive train. Further, although the latching mechanism is described in the context of an electric motor assembly, it may be integrated into other types of downhole drilling motor assemblies, such as a positive displacement motor, as will be recognized by one of ordinary skill in the art with the benefit of this disclosure. In certain embodiments, the latching mechanism 500 may comprise a latch cam 510, at least one mandrel key 512, a spline mandrel 514, and a latch spring 516. The latch cam 510 may engage an inner circumference of the bearing housing 550. In certain embodiments, the latch cam 510 may be attached to the bearing housing 550 using at least one cam retainer pin 520. In certain embodiments, the latch cam 510 may rotate at substantially the same velocity as the housing rotation velocity. The at least one cam retainer pin may be secured with a cam retainer cap 521 and sealed with at least one cam retainer seal 522. The spline mandrel 514 may be within an annulus between the drive shaft 170 and the latch cam 510, wherein the spline mandrel 514 may engage the latch cam 510. In certain embodiments, the spline mandrel 514 may comprise a fluid flow path 526 through the spline mandrel 514 to allow fluid to pass through the spline mandrel 514 in the annulus between the drive shaft 170 and the bearing housing 550.

The latch cam 510 may comprise a cam path 518 disposed within the latch cam 510. The at least one mandrel key 512 may be attached to the spline mandrel 514 and disposed within the cam path 518. In certain embodiments, grease may be placed in the cam path 518 to reduce friction between the cam path 518 and the at least one mandrel key 512. At least one cam path seal 524 may separate the cam path 518 from drilling muds and/or production fluids. The latch spring 516 may engage the latch cam 510 to bias the latch cam 510 against the at least one mandrel key 512 to maintain contact between the latch cam 510 and the at least one mandrel key 512.

At least one spline mandrel spline 540 disposed on the spline mandrel 514 may engage at least one drive shaft spline 542 disposed on the drive shaft 170. As such, rotation of the drive shaft 170 may rotate the spline mandrel 514 by engaging the at least one spline mandrel spline 540 with the at least one drive shaft spline 542. In addition, rotation of the spline mandrel 514 may cause the drive shaft 170 to rotate by engaging the at least one drive shaft spline 542 with the spline mandrel 514. Thus, in certain embodiments, the spline mandrel 514 and the drive shaft 170 may have substantially the same rotation velocity.

Figure 14A:
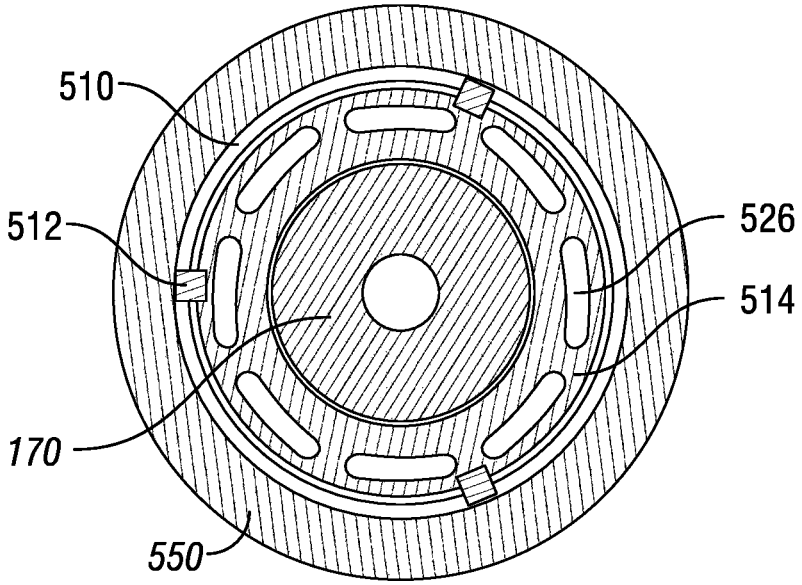
FIGS. 14A and 14B are cross-sectional views of the latching mechanism shown in FIG. 12 at cross-section A and B, respectively.
Figure 14B:
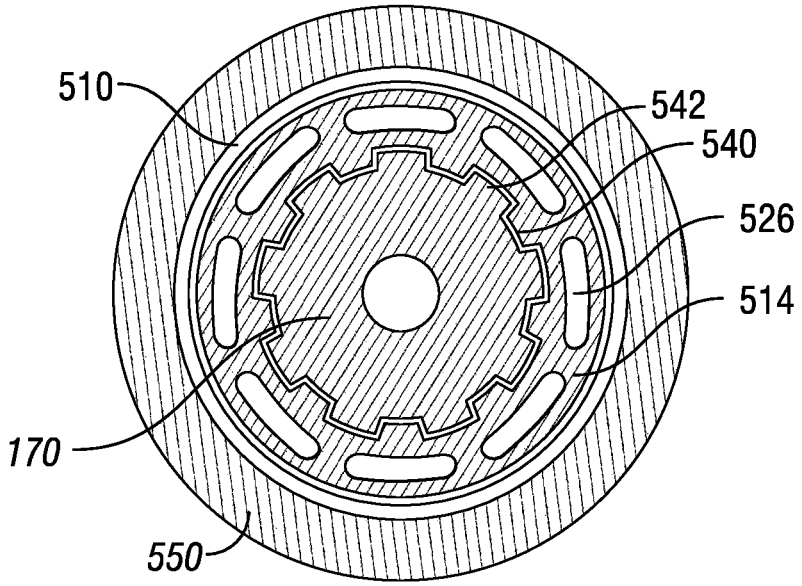

Referring now to FIGS. 14A and 14B, cross-sectional views of the latching mechanism shown in FIG. 12 are shown at cross-section A and B, respectively. The latch cam 510 and spline mandrel 514 may be in the annulus between the bearing housing 550 and the drive shaft 170, as shown in FIG. 14A. The at least one mandrel key 512 may extend from the spline mandrel 514 into the cam path 518 created within the latch cam 510. In certain embodiments, the flow path 526 may be a plurality of openings on the spline mandrel 514 to allow fluid to pass through the spline mandrel 514. Now with reference to FIG. 14B, the at least one spline mandrel spline 540 disposed on the spline mandrel 514 may engage the at least one drive shaft spline 542 disposed on the outer circumference of the drive shaft 170. The at least one spline mandrel spline 540 may transfer mechanical energy to the drive shaft 170 via the at least one drive shaft spline 542. In addition, the at least one drive shaft spline 542 may transfer mechanical energy to the spline mandrel 514 via the at least one spline mandrel spline 540.

Figure 15:
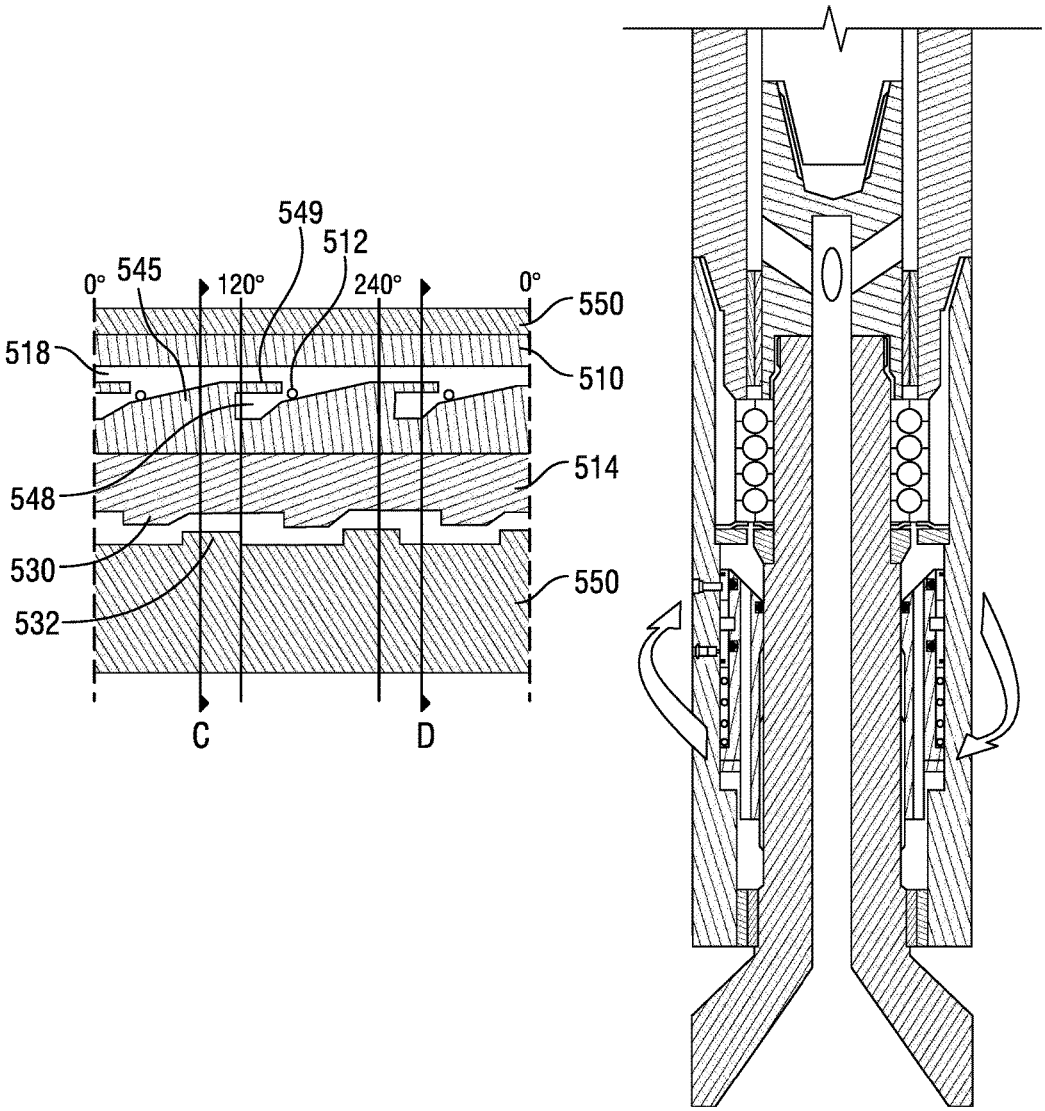
FIG. 15 is a roll-out view of an example latching mechanism, according to aspects of the present disclosure.

Referring now to FIG. 15, a roll-out view of the latching mechanism 500 of FIG. 13 is shown, according to aspects of the present disclosure. Indicator C corresponds to the latching mechanism view on the right side of the cross-section shown in FIG. 13 and Indicator D corresponds to the latching mechanism view on the left side of the cross-section shown in FIG. 13. Thus, FIG. 14 illustrates the circumference of the latching mechanism laid out on a plane. The spline mandrel 514 may comprise at least one spline key 530 disposed on the opposite surface of the spline mandrel 514 from the latch cam 510. The latching mechanism may have an open position, where the at least one spline key 530 is not engaging the at least one housing key 532 (as shown in and discussed with reference to FIGS. 16A-C), and a locked position, where the at least one spline key 530 may engage the at least one housing key 532 (as shown in and discussed with reference to FIG. 16F). In the locked position, the at least one spline key 530 may be configured to engage an at least one housing key 532 disposed on the bearing housing 550

Referring now to FIGS. 16A-C, a sequence of roll-out views of the latching mechanism 500 is shown as the drive shaft 170 has a greater rotation velocity than the bearing housing 550, according to aspects of the present disclosure. As discussed previously, the bearing housing 550 and the latch cam 510 rotate at substantially the same velocity while the spline mandrel 514 and the at least one mandrel key 512 rotate at substantially the same velocity as the drive shaft. As such, when the drive shaft rotates faster than the housing, the at least one mandrel key 512 may move through the cam path 518 in the open direction, to the right as shown in FIGS. 16A-F. The latch spring 516 may bias the spline mandrel 514 to the locked position and keep the at least one mandrel key 512 engaged with a cam path engaging surface 545.

The cam path 518 may comprise a locking slot 548. When the at least one mandrel key 512 is located in the locking slot 548, the at least one spline key 530 may engage the at least one housing key 532. When the at least one mandrel key 512 is not located in the locking slot 548, the at least one spline key 530 may not engage the at least one housing key 532. In other words, the at least one spline key 530 may engage the at least one housing key 532 only when the at least one mandrel key is in the locking slot 548. As the at least one mandrel key 512 moves through the cam path 518 in the open direction, a cam path member 549 may prevent the at least one mandrel key 512 from moving to the locking slot 548. As such, as the at least one mandrel key 512 moves through the cam path 518 in the open direction (when the drive shaft is rotating faster than the bearing housing 550) the latching mechanism stays in the open position. When in the open position, the latching mechanism may transfer substantially no mechanic force to the drive shaft.

Referring now to FIGS. 16D-F, a sequence of roll-out views of the latching mechanism 500 is shown as the bearing housing 550 has a greater rotation velocity than the drive shaft 170, according to aspects of the present disclosure. As the latching cam 510 rotates faster than the at least one mandrel key 512, the at least one mandrel key 512 will move through the cam path 518 in a locking direction. FIG. 16D shows the at least one mandrel key near the locking slot 548. As the at least one mandrel key 512 moves in the locking direction, the cam path mandrel 549 does not prevent the at least one mandrel key 512 from entering the locking slot 548, as shown in FIG. 16E. When the at least one mandrel key 512 finally moves into the locking slot 548, as shown in FIG. 16F, the latching mechanism may be in the locked position and the at least one spline key 530 may engage the at least one housing key 532. As such, the at least one housing key 532 may transfer mechanical force from the bearing housing 550 to the drive shaft via the spline mandrel 514 (as the spline mandrel 514 may transfer mechanical force to the drive shaft through the at least one spline mandrel spline).

In certain embodiments, after the latching mechanism enters the locked position, the drive shaft may began rotating faster than the bearing housing 550, where the at least one mandrel key 512 may begin through the cam path 518 in the open direction. The at least one mandrel key 512 may move in the open direction to exit the locking slot 548. Once the at least one mandrel key 512 is out of the locking slot 548, the latch cam 510 may exert a force on the at least one mandrel key 512 causing the spline mandrel 514 to move from the locked position to the open position, shown again with reference to FIG. 16A.

In certain embodiments, the at least one mandrel key 512 may be a plurality of mandrel keys. The plurality of mandrel keys may be placed substantially evenly spaced around the circumference of the spline mandrel 514.

In certain embodiments, the latching mechanism may not be limited to the precise configuration described in reference to FIG. 13. For example, referring now to FIG. 17, a cross-section of a latching mechanism 500 is shown disposed between the drive shaft 170 and the bearing housing 550 of the motor, according to aspects of the present disclosure. In certain embodiments, the latching mechanism 500 may comprise a spline mandrel 514, a latch spring 516, and at least one cam retainer pin 520. The at least one cam retainer pin 520 may be secured with a cam retainer cap 521 and sealed with at least one cam retainer seal 522. The spline mandrel 514 may engage an inner circumference of the bearing housing 550. In certain embodiments, the spline mandrel 514 may comprise a fluid flow path 526 through the spline mandrel 514 to allow fluid to pass through the spline mandrel 514 in the annulus between the drive shaft 170 and the bearing housing 550.

The spline mandrel 514 may comprise a cam path 518 disposed within the spline mandrel 514. The at least one cam retainer pin 520 may extend from the bearing housing 550 into the cam path 518. In certain embodiments, grease may be placed in the cam path 518 to reduce friction between the cam path 518 and the at least one cam retainer pin 520. At least one cam path seal 524 may separate the cam path 518 from drilling muds and/or production fluids. The latch spring 516 may engage the spline mandrel 514 to bias the spline mandrel 514 against the at least one cam retainer pin 520 to maintain contact between the spline mandrel 514 and the at least one cam retainer pin 520. The cam path 518 may be configured as discussed with reference to FIGS. 15 and 16A-16F.

The drive shaft may rotate slower than the housing in a number of situations. For example, the electric motor may slip or otherwise fail. In the case that the electric motor fails, the latching mechanism may prevent slipping by electric motor as the housing rotates. Instead, the latching mechanism may allow torque supplied to the housing from the surface to be delivered to the drive shaft. Thus, during an electric motor failure, torque supplied to the housing at the surface may be used to unstick a drill bit and/or drive the drilling operation while the electric motor is inactive.

Figure 18A:
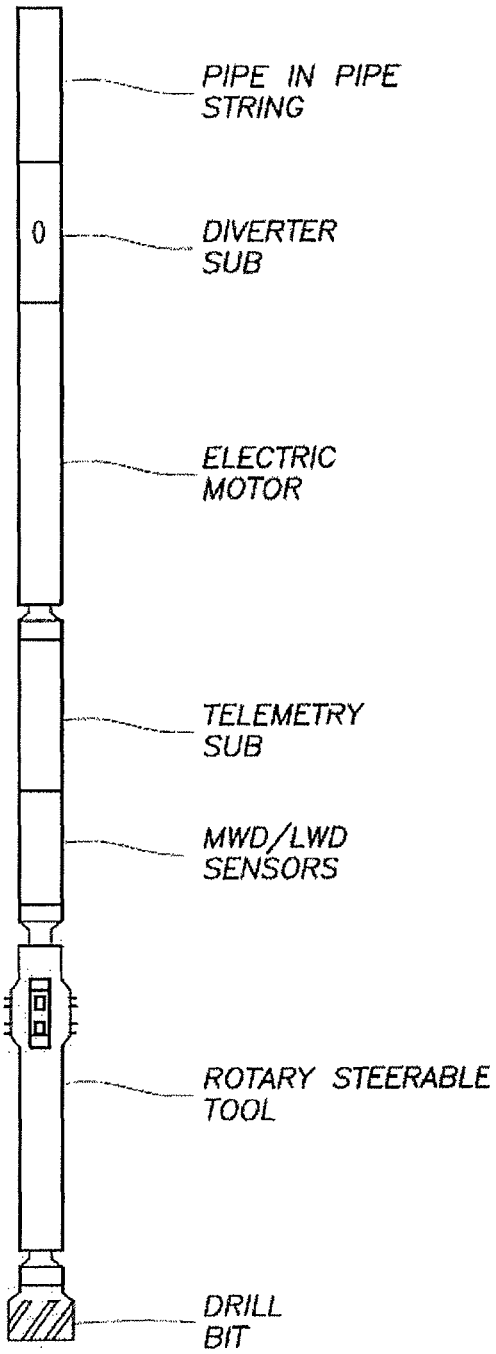

Referring now to FIGS. 18A-18F, various steerable BHA stack ups are illustrated, in accordance to certain embodiments of the present disclosure. In certain embodiments, as shown in FIG. 18A, the BHA may be rotated by the electric motor that drives the shaft of a rotary steerable tool. In other embodiments, the electric motor may be fitted with a through motor telemetry system that jumps communications from the non-rotating stator to the drive shaft through using a slip ring or an inductive coupler. Other short hop telemetry techniques exist and are known to those skilled in the art with the benefit of the present disclosure.

Figure 18B:
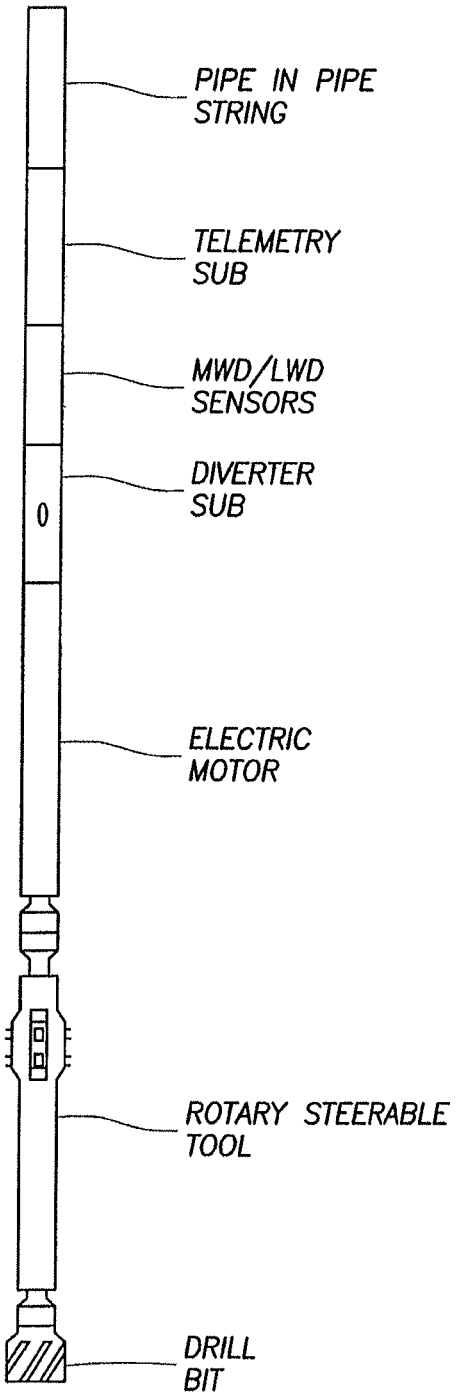

In certain embodiments, a rotary steerable BHA stack up may be configured in accordance to FIG. 18B. In this embodiment, the MWD/LWD may be moved above the electric motor. Sensors may be mounted in outsets rather than inserts, attached from the side of the tool rather than inserted into the end of the tool and may slide into position and be covered over by protective hatches or sleeves, as needed. The center bore of the string may maintain the center pipe for managing return flow. In this manner the MWD supports both flow paths (up and down) inside its confines. The MWD/LWD sensors may be arranged to permit flow through various means, such as by maintaining the two inner flow paths as two concentric pipes and mounting the MWD/LWD components in external radial positions to these flow path as is shown in FIG. 18F. Alternately, the diverter sub may be placed above the MWD, allowing a conventional MWD to be used. However, a means for connecting the electrical power to the lower motor may be required, which may require a cable or other insulated conductor to be run from the upper diverter assembly, through the MWD/LWD section, and to the power input section on top of the electric motor.

Figure 18C:
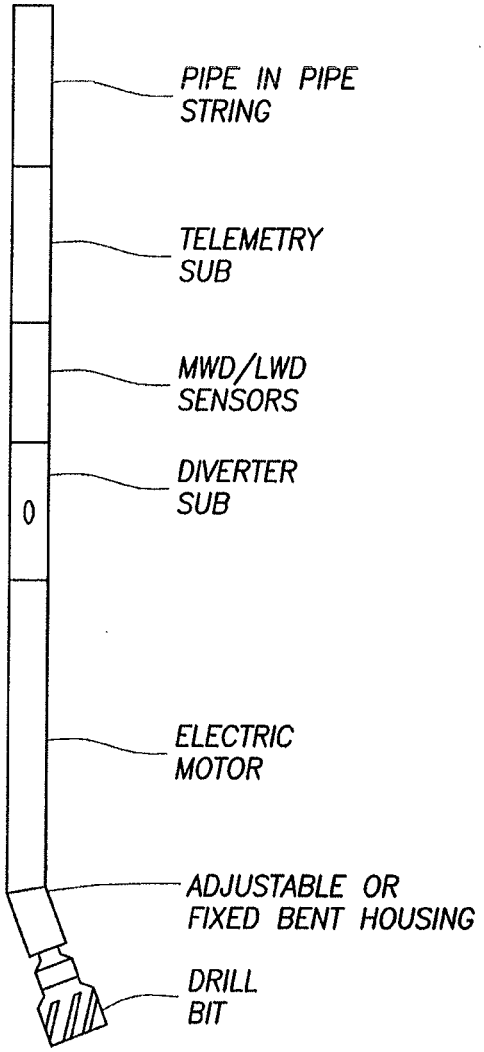

In certain embodiments, a rotary steerable BHA stack up may be configured in accordance with FIG. 18C. In this embodiment, the electric motor may have a bent housing assembly attached using an internal coupling or torsion rod to facilitate the transfer of torque from the upper shaft to the lower shaft. As discussed earlier the axial bearing may be positioned above or below the bent sub. The bent sub may be fixed, adjustable, or down hole adjustable.

Figure 18D:
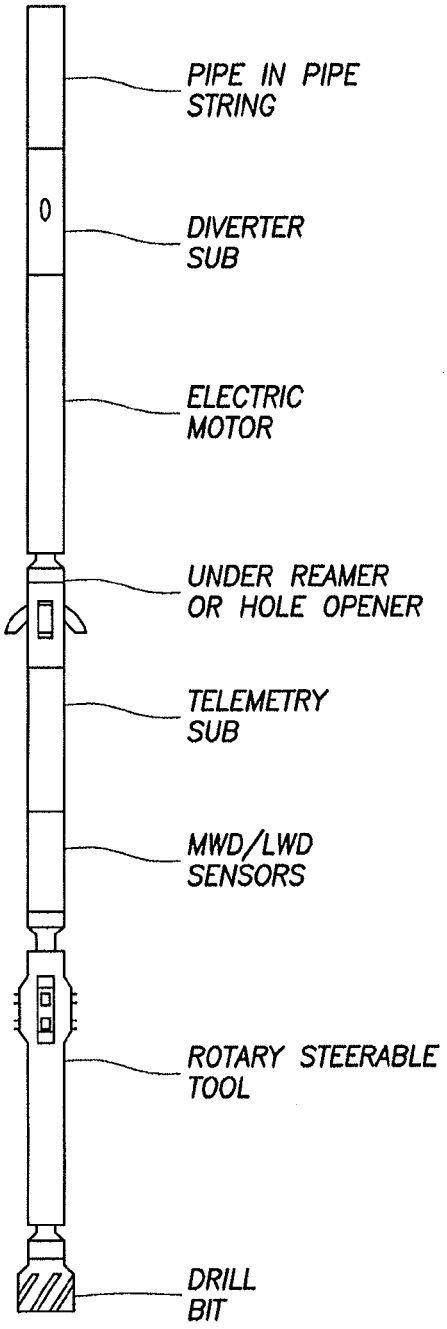

In certain embodiments, a steerable BHA stack up may be configured in accordance to FIG. 18D. In this embodiment, the electric motor may provide power to an under reamer or a hole opener and may drive a rotor steerable assembly. In this case, both cutting structures may be rotated by the electric motor.

Figure 18E:
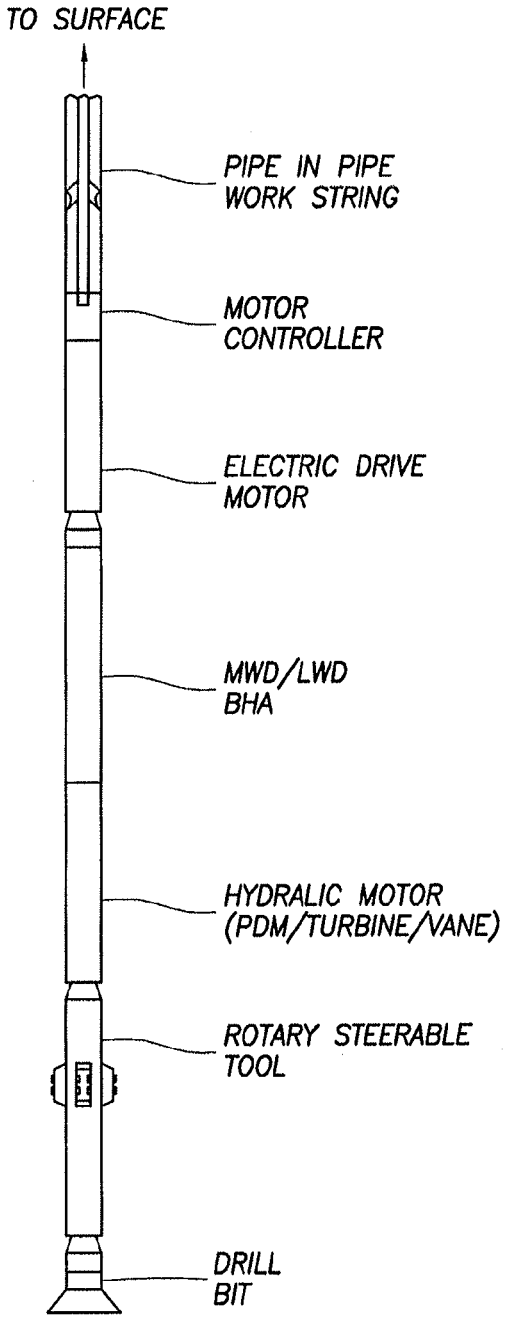
Figure 18F:
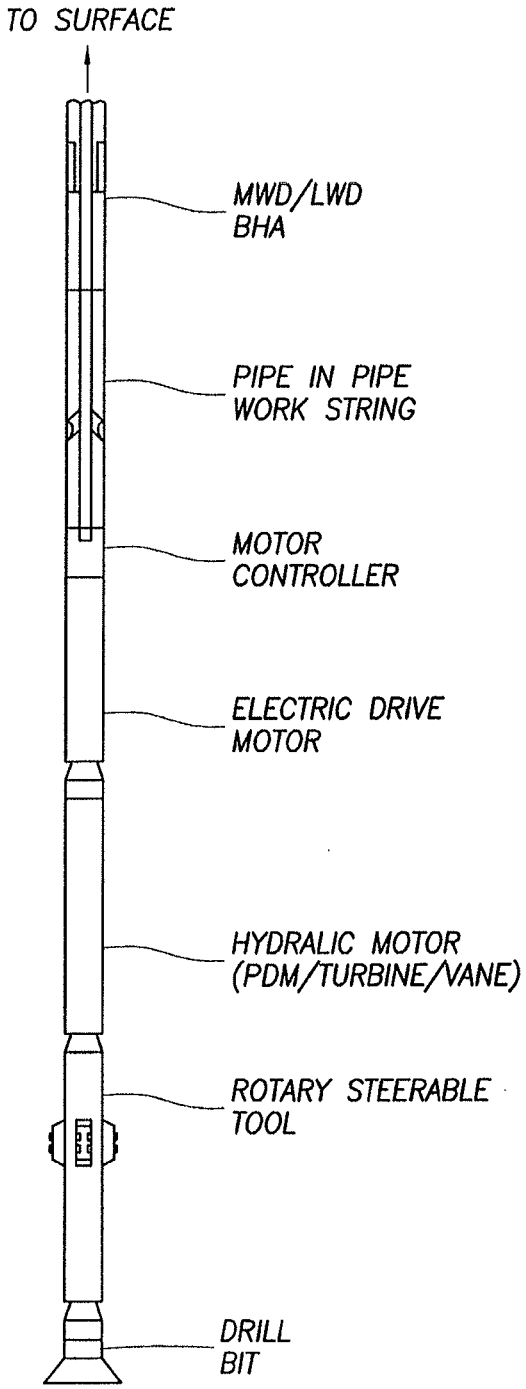

In certain embodiments, a rotary steerable BHA stack up may be configured in accordance to FIG. 18E. This configuration may allow a conventional MWD/LWD to be utilized. In certain embodiments, a hydraulic motor may be inserted below the MWD/LWD to harness additional power to drive the bit. Such dual use of both electric and hydraulic power from the surface to create torque could be utilized in such a configuration to maximize torque to the bit for the given available power. FIG. 18F illustrates a further configuration of certain embodiments, in accordance with the present disclosure. FIG. 18E may be modified by positioning a diverter below the MWD/LWD as yet another example embodiment.

Further configurations may be apparent in light of this disclosure through reconfiguration and interconnection of the described modules as desired for hydraulic, electric power, and communications needs.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. An electric motor assembly comprising:

a drilling string comprising an inner pipe and an outer pipe, the inner pipe and the outer pipe comprising first and second conductors, respectively;

an electric motor electronically coupled to the inner pipe and the outer pipe to receive current passing through the first and second conductors;

a latching mechanism connecting the drilling string and a drive shaft, wherein the drive shaft is driven by the electric motor, wherein the latching mechanism allows selective rotation of the drive shaft in one direction compared to a rotation direction of a housing of the electric motor, and wherein the latching mechanism is configured to selectively engage the drilling string to prevent the drive shaft from rotating slower than the drilling string; and a flow diverter fluidically coupled to the inner pipe and electrically insulated from the outer pipe, wherein the flow diverter allows fluid flow to an end of the drilling string and fluidly couples an interior of the inner pipe to an exterior of the outer pipe.

2. The electric motor assembly of claim 1, wherein the latching mechanism comprises a latch cam and at least one key engaging the latch cam, wherein the latch cam engages the drilling string and the drive shaft rotates the at least one key, and wherein the at least one key moves into a locking slot when the drive shaft rotates slower than the drilling string.

3. The electric motor assembly of claim 1, wherein at least one of the inner pipe or the outer pipe is coated with an insulating material.

4. The electric motor assembly of claim 1, wherein the drive shaft comprises a drive shaft magnet.

5. The electric motor assembly of claim 1, wherein the electric motor is coupled to a drill bit.

6. The electric motor assembly of claim 1, wherein the electric motor is coupled to a lower drill string segment.

7. The electric motor assembly of claim 1, wherein the electric motor is coupled to an upper drill string segment.

8. A method of providing power to an electric motor comprising:

providing a drilling string comprising an inner pipe and an outer pipe, the inner pipe and the outer pipe comprising first and second conductors, respectively, electrically coupling an electric motor to the inner pipe and the outer pipe;

connecting the drilling string and a drive shaft with a latching mechanism, wherein the drive shaft is driven by the electric motor, wherein the latching mechanism allows selective rotation of the drive shaft in one direction compared to a rotation direction of a housing of the electric motor, and wherein the latching mechanism prevents the drive shaft from rotating slower than the drilling string;

generating current through the inner pipe, electric motor, and outer pipe; and providing a flow diverter fluidically coupled to the inner pipe and electrically insulated from the outer pipe, wherein the flow diverter allows a fluid to flow to an end of the drilling string and fluidly couples an interior of the inner pipe to an exterior of the outer pipe.

9. The method of claim 8, wherein providing the drilling string comprising the inner pipe and the outer pipe comprises, coating at least one of the inner pipe or the outer pipe with an insulating material.

10. The method of claim 9, wherein the insulating material comprises a dielectric material.

11. The method of claim 10, wherein the dielectric material comprises at least one material selected from the group consisting of a polyimide, a high strength toughened fluoropolymer, nylon, teflon, and a ceramic coating.

12. The method of claim 8, wherein connecting the drilling string and the drive shaft with the latching mechanism comprises coupling the drive shaft to the electric motor, wherein the electric motor is configured to apply torque to the drive shaft.

13. The method of claim 8, wherein the drive shaft comprises a drive shaft magnet.

14. The method of claim 8, wherein the electric motor is coupled to a drill bit.

15. A method of drilling a wellbore in a subterranean formation comprising:

providing a drilling string comprising an inner pipe and an outer pipe, electrically coupling an electric motor to the inner pipe and the outer pipe;

connecting the drilling string and a drive shaft with a latching mechanism, wherein the drive shaft is driven by the electric motor, wherein the latching mechanism allows selective rotation of the drive shaft in one direction compared to a rotation direction of a housing of the electric motor, and wherein the latching mechanism prevents the drive shaft from rotating slower than the drilling string;

generating current through the inner pipe, electric motor, and outer pipe;

applying rotational power to a drill bit coupled to the drive shaft; and flowing a fluid through a flow diverter fluidically coupled to the inner pipe and electrically insulated from the outer pipe, wherein the flow diverter allows the fluid to flow to an end of the drilling string and fluidly couples an interior of the inner pipe to an exterior of the outer pipe.

16. The method of claim 15, wherein providing the drilling string comprising the inner pipe and the outer pipe comprises, coating at least one of the inner pipe or the outer pipe with an insulating material.

17. The method of claim 16, wherein the insulating material comprises a dielectric material.

18. The method of claim 15, wherein applying rotational power to the drill bit coupled to the drive shaft comprises rotating the drilling string.

19. The method of claim 15, wherein the drive shaft comprises a drive shaft magnet.

* * * * *